US010391603B2

(12) United States Patent
Yamaki et al.

(10) Patent No.: US 10,391,603 B2
(45) Date of Patent: Aug. 27, 2019

(54) POLISHING APPARATUS, CONTROL METHOD AND RECORDING MEDIUM

(71) Applicant: EBARA CORPORATION, Tokyo (JP)

(72) Inventors: Satoru Yamaki, Tokyo (JP); Hozumi Yasuda, Tokyo (JP); Keisuke Namiki, Tokyo (JP); Osamu Nabeya, Tokyo (JP); Makoto Fukushima, Tokyo (JP); Shingo Togashi, Tokyo (JP); Shintaro Isono, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 395 days.

(21) Appl. No.: 15/378,761

(22) Filed: Dec. 14, 2016

(65) Prior Publication Data

US 2017/0173756 A1 Jun. 22, 2017

(30) Foreign Application Priority Data

Dec. 18, 2015 (JP) ..... 2015-246856

(51) Int. Cl.
*B24B 49/10* (2006.01)
*B24B 37/005* (2012.01)
*B24B 37/20* (2012.01)

(52) U.S. Cl.
CPC ..... *B24B 37/005* (2013.01); *B24B 37/20* (2013.01)

(58) Field of Classification Search
CPC ..... B24B 49/10; B24B 49/00; B24B 37/00
(Continued)

(56) References Cited

U.S. PATENT DOCUMENTS 5,036,015 A * 7/1991 Sandhu ..... B24B 37/013 216/84
5,733,171 A * 3/1998 Allen ..... B24B 37/0053 451/41

(Continued)

FOREIGN PATENT DOCUMENTS

JP H08-229804 A 9/1996
JP 2000-288928 A 10/2000

(Continued)

OTHER PUBLICATIONS

Japan Patent Application No. 2015-246856; Reasons for Refusal; dated Apr. 2, 2019; 11 pages.

*Primary Examiner* — Robert A Rose
(74) *Attorney, Agent, or Firm* — Baker & Hostetler LLP

(57) ABSTRACT

A polishing object is prevented from slipping out without depending on the process type or the polishing condition. A polishing apparatus for polishing a surface to be polished of an polishing object by sliding the surface to be polished and a polishing member relative to each other, including: a pressing unit that presses a back surface of the surface to be polished of the polishing object such that the surface to be polished is pressed against the polishing member; a retainer member that is arranged on an outer side of the pressing unit and presses the polishing member; a storage unit that stores information concerning a condition for preventing the polishing object from slipping out, the condition being defined by use of information concerning a pressing force of the retainer member; and a control unit that acquires information concerning a force of friction between the surface to be polished of the polishing object and the polishing member or information concerning the pressing force of the retainer member, and executes control for adapting to the condition for preventing the slipping-out by using the acquired infor- (Continued)

mation concerning the force of friction or the acquired information concerning the pressing force of the retainer member.

19 Claims, 13 Drawing Sheets

(58) Field of Classification Search
USPC ..... 451/5, 8, 9, 10, 41, 288, 289, 290
See application file for complete search history.

(56) References Cited

U.S. PATENT DOCUMENTS 6,293,846 B1 * 9/2001 Oguri ..... B24B 37/0053 257/E21.001
6,634,924 B1 * 10/2003 Ono ..... B24B 37/0053 451/287
7,258,595 B2 * 8/2007 Tada ..... B24B 37/005 156/345.14
7,727,049 B2 * 6/2010 Benvegnu ..... B24B 37/013 451/285
2001/0051492 A1 * 12/2001 Donohue ..... B24B 37/0053 451/8
2002/0130989 A1 9/2002 Nakao et al.
2003/0180973 A1 * 9/2003 Lehman ..... B24B 37/013 438/14
2004/0033761 A1 2/2004 Ono et al.
2004/0072500 A1 4/2004 Birang et al.
2005/0136800 A1 * 6/2005 Miller ..... B24B 37/013 451/5
2008/0146119 A1 6/2008 Sasaki et al.
2015/0266159 A1 9/2015 Shiokawa et al.

FOREIGN PATENT DOCUMENTS

JP 2001-096455 A 4/2001
JP 2001-110768 A 4/2001
JP 2003-282505 A 10/2003
JP 2005-131732 A 5/2005
JP 2008-528300 A 7/2008
JP 2010-247301 A 11/2010
JP 2014-086568 A 5/2014
JP 2015-193068 A 11/2015

* cited by examiner

POLISHING APPARATUS, CONTROL METHOD AND RECORDING MEDIUM

CROSS-REFERENCE TO RELATED APPLICATIONS

This application claims the benefit of Japanese Priority Patent Application JP 2015-246856 filed on Dec. 18, 2015, the entire contents of which are incorporated herein by reference.

FIELD

This technique is related to polishing apparatus, control method and recording medium.

BACKGROUND AND SUMMARY

In recent years, as semiconductor devices are made highly integrated and highly dense, circuit interconnections have become finer and the number of layers of multi-layer interconnections has been increased. Aiming at achieving multi-layer interconnection while aiming at finer circuitry leads to film coverage of step geometry (step coverage) being lowered in thin film formation as the number of the interconnected layers increases because surface steps increase while following surface irregularities on a lower layer. Therefore, in order to obtain multi-layer interconnection, this step coverage has to be improved to perform a planarization process at an appropriate time. In addition, since finer optical lithography entails shallower depth of focus, it is necessary to subject a surface of a semiconductor device to the planarization process so that surface steps of irregularities on the surface of the semiconductor device fall within the depth of focus. As the circuitry is made finer, a requirement for accuracy with respect to the planarization process has been raised. Not only in a multi-layer interconnecting process but also at a FEOL (Front End Of Line), as a transistor's peripheral structure is complexed, the requirement for accuracy with respect to the planarization process has been raised.

In this way, in a manufacturing process of the semiconductor device, a planarization technique for the semiconductor device surface has become important more and more. In this planarization technique, the most important technique is chemical mechanical polishing (CMP). This chemical mechanical polishing is a process in which a polishing apparatus is used to perform polishing by supplying a polishing liquid containing abrasive grains such as of silica ($SiO_2$) onto a polishing surface of a polishing pad or the like and bringing a substrate such as a semiconductor wafer into sliding contact with the polishing surface.

This type of polishing apparatus includes a polishing table having a polishing surface formed of a polishing pad, and a substrate holder, called a top ring or a polishing head, for holding the semiconductor wafer. In a case where such a polishing apparatus is used to polish the semiconductor wafer, the semiconductor wafer is held by the substrate holder and the semiconductor wafer is pressed against the polishing surface at a predetermined pressure. At this time, the polishing table and the substrate holder are moved relatively to each other such that the semiconductor wafer is brought into sliding contact with the polishing surface to polish the surface of the semiconductor wafer to a flat and mirror finish.

In such a polishing apparatus, if a relative pressing force between the semiconductor wafer and the polishing surface of the polishing pad during polishing is not uniform over the entire surface of the semiconductor wafer, insufficient polishing or excessive polishing would occur depending on the pressing force applied to any portion of the semiconductor wafer. In order to unify the pressing force applied to the semiconductor wafer, a pressure chamber formed of an elastic membrane (membrane) is provided at a lower part of the substrate holder, and, by supplying a fluid such as pressurized air to this pressure chamber, the semiconductor wafer is pressed against the polishing surface of the polishing pad by means of a fluid pressure via the elastic membrane to perform polishing.

The substrate holder is provided with a retainer ring surrounding the semiconductor wafer (e.g., see Patent Literature 1), and when polishing the semiconductor wafer, the retainer ring is pressed against the polishing surface at a predetermined pressure so that the semiconductor wafer held by the substrate holder does not get out of the polishing head. Here, a pressing force of the retainer ring is also an adjustment parameter for adjusting a polishing profile of a periphery of the semiconductor wafer.

As the pressing force of the retainer ring is lowered, a phenomenon cannot be prevented that the retainer ring on a downstream side of table rotation is uplifted by a horizontal force from the wafer caused by friction between the wafer and the polishing pad and the semiconductor wafer during polishing cannot not be held, and thereby, the semiconductor wafer slides on the polishing pad to get out to the outside (hereinafter, referred to as sipping out) at a certain pressing force of the retainer ring (hereinafter, referred to as retainer ring pressure). In order that the semiconductor wafer does not slip out, the retainer ring pressure needs to be set to be equal to or more than a lower limit of retainer ring pressure (hereinafter, also referred to as RRP (retainer ring pressure) lower limit) at which the semiconductor wafer can be polished without slipping out. However, the RRP lower limit varies depending on a process type or a polishing condition, and thus, disadvantageously is difficult to determine.

As for dealing with this problem, there may be considered a method in which polishing is actually performed so as to lower the pressing force of the retainer ring until the semiconductor wafer slips out to measure the RRP lower limit. However, in this method, because the semiconductor wafer actually slips out, expendables such as the membrane or the retainer ring may be broken in some cases. Such a method would require time also. Further, the RRP lower limit varies depending on the process type or the polishing condition, which involves a need to conduct a test for finding the RRP lower limit every time the process type or the polishing condition is changed. However, it is not realistic to conduct a test for finding the RRP lower limit every time the process type or the polishing condition is changed, considering time and effort are taken.

It is desired to provide a polishing apparatus, a control method and, a recording medium capable of preventing an polishing object from slipping out without depending on the process type or the polishing condition.

A polishing apparatus according to one aspect of this technique, a polishing apparatus for polishing a surface to be polished of an polishing object by sliding the surface to be polished and a polishing member relative to each other, comprising: a pressing unit that presses a back surface of the surface to be polished of the polishing object such that the surface to be polished is pressed against the polishing member; a retainer member that is arranged on an outer side of the pressing unit and presses the polishing member; a storage unit that stores information concerning a condition for preventing the polishing object from slipping out, the condition being defined by use of information concerning a pressing force of the retainer member; and a control unit that acquires information concerning a force of friction between the surface to be polished of the polishing object and the polishing member or information concerning the pressing force of the retainer member, and executes control for adapting to the condition for preventing the slipping-out by using the acquired information concerning the force of friction or the acquired information concerning the pressing force of the retainer member.

By doing so, the condition for preventing the polishing object from slipping out is not changed even if the process type or the polishing condition is varied, which makes it possible to prevent the polishing object from slipping out without depending on the process type or the polishing condition.

A control method according to one aspect of this technique, a control method for executing control by way of referencing a storage unit that stores information concerning a condition for preventing an polishing object from slipping out, the condition being defined by use of information concerning a pressing force of a retainer member, the method comprising: a step of acquiring information concerning a force of friction between a surface to be polished of the polishing object and a polishing member, or the information concerning the pressing force of the retainer member; and a step of executing control for adapting to the condition for preventing the slipping-out by using the acquired information concerning the force of friction or the acquired information concerning the pressing force of the retainer member.

By doing so, the condition for preventing the polishing object from slipping out is not changed even if the process type or the polishing condition is varied, which makes it possible to prevent the polishing object from slipping out without depending on the process type or the polishing condition.

A recording medium according to one aspect of this technique, a recording medium storing therein in a non-transitory manner a program for executing control by way of referencing a storage unit that stores information concerning a condition for preventing an polishing object from slipping out, the condition being defined by use of information concerning a pressing force of a retainer member, the program causing a computer to execute: a step of acquiring information concerning a force of friction between a surface to be polished of the polishing object and a polishing member, or the information concerning the pressing force of the retainer member; and a step of executing control for adapting to the condition for preventing the slipping-out by using the acquired information concerning the force of friction or the acquired information concerning the pressing force of the retainer member.

By doing so, the condition for preventing the polishing object from slipping out is not changed even if the process type or the polishing condition is varied, which makes it possible to prevent the polishing object from slipping out without depending on the process type or the polishing condition.

DETAILED DESCRIPTION OF NON-LIMITING EXAMPLE EMBODIMENTS

Figure 1:
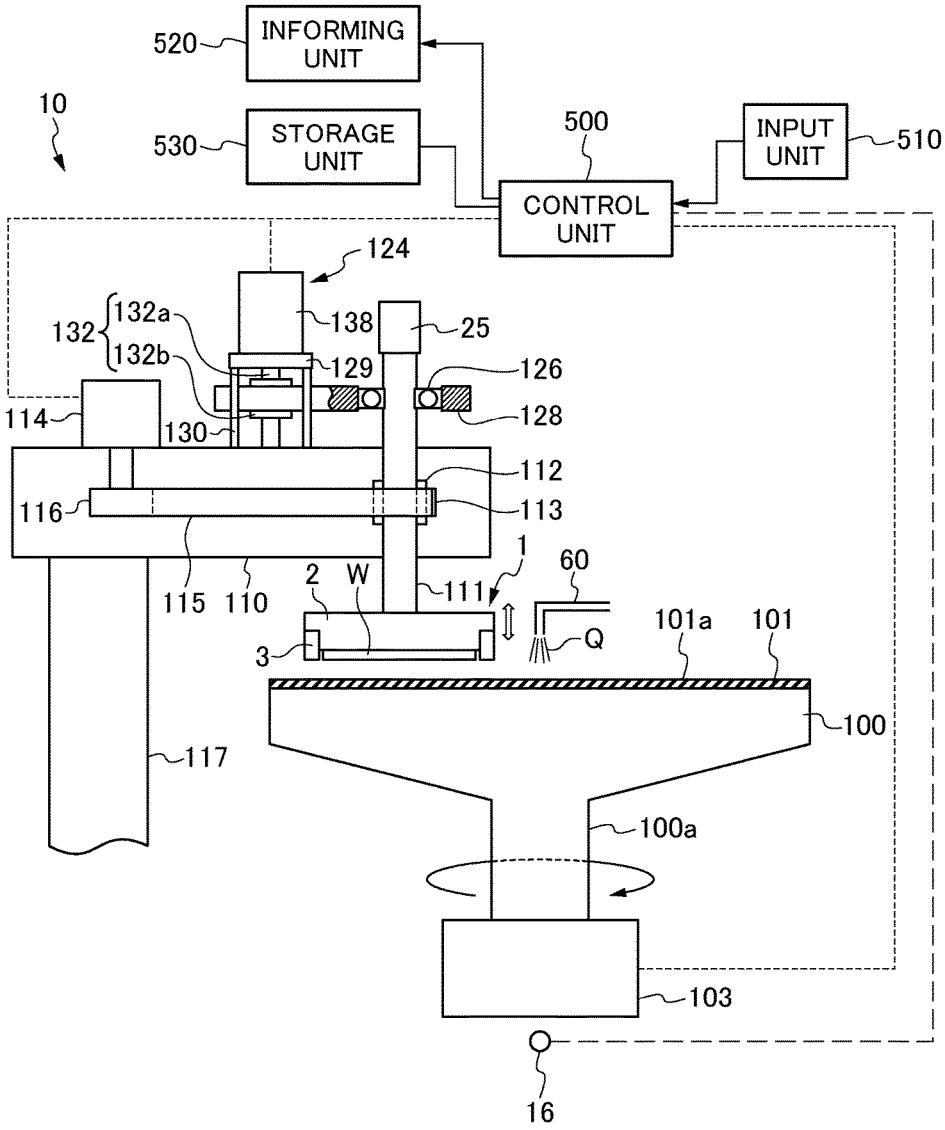
FIG. 1 is a schematic view showing a general configuration of a polishing apparatus 10 according to an embodiment of this technique.

Hereinafter, a description is given of an embodiment of this technique with reference to the drawings. Note that the embodiment described below show an example in a case where this technique is implemented, but do not limit the technique to the specific configuration described below. When this technique is implemented, a specific configuration depending on the embodiment may be adequately adopted.

A polishing apparatus according to a first aspect of this technique, a polishing apparatus for polishing a surface to be polished of an polishing object by sliding the surface to be polished and a polishing member relative to each other, comprising: a pressing unit that presses a back surface of the surface to be polished of the polishing object such that the surface to be polished is pressed against the polishing member; a retainer member that is arranged on an outer side of the pressing unit and presses the polishing member; a storage unit that stores information concerning a condition for preventing the polishing object from slipping out, the condition being defined by use of information concerning a pressing force of the retainer member; and a control unit that acquires information concerning a force of friction between the surface to be polished of the polishing object and the polishing member or information concerning the pressing force of the retainer member, and executes control for adapting to the condition for preventing the slipping-out by using the acquired information concerning the force of friction or the acquired information concerning the pressing force of the retainer member.

By doing so, the condition for preventing the polishing object from slipping out is not changed even if the process type or the polishing condition is varied, which makes it possible to prevent the polishing object from slipping out without depending on the process type or the polishing condition.

A polishing apparatus according to a second aspect of this technique, the polishing apparatus according to the first aspect, wherein the control unit controls the pressing force of the retainer member so as to adapt to the condition for preventing the slipping-out depending on the information concerning the force of friction between the surface to be polished of the polishing object and the polishing member during polishing.

By doing so, the condition for not slipping out the polishing object is not changed even if the process type or the polishing condition is varied, which makes it possible to prevent the polishing object from slipping out without depending on the process type or the polishing condition.

A polishing apparatus according to a third aspect of this technique, the polishing apparatus according to the first or second aspect, wherein the information concerning the force of friction between the surface to be polished of the polishing object and the polishing member is a pressing force of the pressing unit during polishing, the information concerning the condition for preventing the polishing object from slipping out is a relationship between the pressing force of the pressing unit and a lower limit of the pressing force of the retainer member at which the polishing object does not slip out, and the control unit acquires a current pressing force of the pressing unit during polishing of the surface to be polished, applies the current pressing force of the pressing unit to the relationship between the pressing force of the pressing unit and the lower limit of the pressing force of the retainer member at which the polishing object does not slip out, determines the lower limit of the pressing force of the retainer member at which the polishing object does not slip out, and controls the pressing force of the retainer member so that the pressing force of the retainer member is equal to or more than the lower limit.

By doing so, the pressing force of the retainer member is set to be equal to or more than the lower limit of the pressing force of the retainer member at which the polishing object does not slip out, which makes it possible to prevent the polishing object from slipping out.

A polishing apparatus according to a forth aspect of this technique, the polishing apparatus according to the third aspect, wherein the control unit keeps the current pressing force of the retainer member if the current pressing force of the retainer member is equal to or more than the lower limit, and sets the pressing force of the retainer member to the lower limit if the current pressing force of the retainer member is less than the lower limit.

By doing so, the pressing force of the retainer member is always set to be equal to or more than the lower limit of the pressing force of the retainer member at which the polishing object does not slip out, which makes it possible to prevent the polishing object from slipping out.

A polishing apparatus according to a fifth aspect of this technique, the polishing apparatus according to the first aspect, wherein the information concerning the force of friction between the surface to be polished of the polishing object and the polishing member is a setting value for a pressing force of the pressing unit, the information concerning the condition for preventing the polishing object from slipping out is a relationship between the pressing force of the pressing unit and a lower limit of the pressing force of the retainer member at which the polishing object does not slip out, and the control unit acquires the setting value for the pressing force of the pressing unit and a setting value for the pressing force of the retainer member, applies the setting value for the pressing force of the pressing unit to the relationship between the pressing force of the pressing unit and the lower limit of the pressing force of the retainer member at which the polishing object does not slip out, determines the lower limit of the pressing force of the retainer member at which the polishing object does not slip out, and executes control for informing in a case where the setting value for the pressing force of the retainer member falls below the lower limit.

By doing so, an operator is informed in the case where a setting value for the pressing force of the retainer member falls below the lower limit of the pressing force of the retainer member at which the polishing object does not slip out, allowing the operator to set the setting value for the pressing force of the retainer member to a value equal to or more than the lower limit. This makes it possible to prevent the polishing object from slipping out.

A polishing apparatus according to a sixth aspect of this technique, the polishing apparatus according to any one of the third to fifth aspect, wherein the relationship between the pressing force of the pressing unit and the lower limit of the pressing force of the retainer member at which the polishing object does not slip out is determined based on a relationship between the information concerning the force of friction between the surface to be polished of the polishing object and the polishing member and the lower limit of the pressing force of the retainer member at which the polishing object does not slip out in a virtual case where the retainer member is not pressed against the polishing member and the polishing object is pressed against the polishing member as well as a relationship between the information concerning the force of friction between the surface to be polished of the polishing object and the polishing member and the pressing force of the pressing unit.

This defines a relationship between the pressing force of the pressing unit and the lower limit of the pressing force of the retainer member at which the polishing object does not slip out.

A polishing apparatus according to a seventh aspect of this technique, the polishing apparatus according to the sixth aspect, wherein the control unit acquires, when a coefficient of friction between the surface to be polished and the polishing member may possibly change, the relationship between the information concerning the force of friction between the surface to be polished of the polishing object and the polishing member and the pressing force of the pressing unit in the virtual case where the retainer member is not pressed against the polishing member and the polishing object is pressed against the polishing member, and updates the relationship between the pressing force of the pressing unit and the lower limit of the pressing force of the retainer member at which the polishing object does not slip out by using the acquired relationship.

By doing so, every time a coefficient of friction between the surface to be polished and the polishing member may possibly change, updated is the relationship between the pressing force of the pressing unit and the lower limit of the pressing force of the retainer member at which the polishing object does not slip out.

A polishing apparatus according to an eighth aspect of this technique, the polishing apparatus according to the seventh aspect, further comprising: a polishing table that holds the polishing member on a front surface thereof; a table rotary motor that rotates the polishing table; and a pressing unit rotary motor that rotates the pressing unit, wherein the information concerning the force of friction in terms of the relationship between the information concerning the force of friction between the surface to be polished of the polishing object and the polishing member and the pressing force of the pressing unit is the force of friction between the surface to be polished and the polishing member, a rotary torque of the polishing table or a current value of the table rotary motor, or a rotary torque of the pressing unit or a current value of the pressing unit rotary motor.

In this way, information concerning a force of friction between the surface to be polished of the polishing object and the polishing member includes not only the force of friction between the surface to be polished and the polishing member but also a rotary torque of the polishing table or a current value of the table rotary motor, or a rotary torque of the pressing unit or a current value of the pressing unit rotary motor.

A polishing apparatus according to a ninth aspect of this technique, the polishing apparatus according to the first aspect, further comprising: a polishing table that holds the polishing member on a front surface thereof; and a table rotary motor that rotates the polishing table, wherein the information concerning the pressing force of the retainer member is a setting value for the pressing force of the retainer member, the information concerning the condition for preventing the polishing object from slipping out is a relationship between the pressing force of the retainer member and an upper limit of a rotary torque at which the polishing object does not slip out, and the control unit acquires the setting value for the pressing force of the retainer member, applies the acquired setting value for the pressing force of the retainer member to the relationship between the pressing force of the retainer member and the upper limit of the rotary torque at which the polishing object does not slip out, determines the upper limit of the rotary torque at which the polishing object does not slip out, compares the upper limit with a rotary torque of the table rotary motor during polishing of the surface to be polished, and performs a process depending on a comparison result.

By doing so, the control unit can control such that the rotary torque of the table rotary motor during polishing does not exceed the upper limit, which makes it possible to prevent the polishing object from slipping out.

A polishing apparatus according to a tenth aspect of this technique, the polishing apparatus according to the ninth aspect, wherein the process depending on the comparison result is a process to control the polishing to be continued at the setting value for the pressing force of the retainer member if the rotary torque of the table rotary motor during polishing is equal to or less than the upper limit, and to increase the pressing force of the retainer member or perform a predetermined abnormal handling process if the rotary torque of the table rotary motor during polishing exceeds the upper limit.

By doing so, the polishing can be continued in a range where the rotary torque does not exceed the upper limit, and if the rotary torque exceeds the upper limit, the pressing force of the retainer member is increased or a predetermined abnormal handling process is performed, so that the polishing object can be prevented from slipping out.

A polishing apparatus according to a eleventh aspect of this technique, the polishing apparatus according to the ninth or tenth aspect, wherein a relationship between the pressing force of the retainer member and the upper limit of the rotary torque at which the polishing object does not slip out is determined based on the relationship between the pressing force of the retainer member and the upper limit of the rotary torque at which the polishing object does not slip out in a virtual case where the retainer member is not pressed against the polishing member and the polishing object is pressed against the polishing member as well as the relationship between the pressing force of the retainer member and the rotary torque in a case where the retainer member is pressed against the polishing member and the polishing object is not pressed against the polishing member.

This can determine a relationship between the pressing force of the retainer member and the upper limit of the rotary torque at which the polishing object does not slip out.

A polishing apparatus according to a twelfth aspect of this technique, the polishing apparatus according to the eleventh aspect, wherein the control unit acquires, when a coefficient of friction between the surface to be polished and the polishing member may possibly change, the relationship between the pressing force of the retainer member and the rotary torque in the case where the retainer member is pressed against the polishing member and the polishing object is not pressed against the polishing member, and updates the relationship between the pressing force of the retainer member and the upper limit of the rotary torque at which the polishing object does not slip out by using the acquired relationship.

By doing so, every time the coefficient of friction between the surface to be polished and the polishing member may possibly change, updated is the relationship between the pressing force of the retainer member and the upper limit of the rotary torque at which the polishing object does not slip out.

A polishing apparatus according to a thirteenth aspect of this technique, the polishing apparatus according to the first aspect, wherein the information concerning the force of friction between the surface to be polished of the polishing object and the polishing member is a pressing force of the pressing unit during polishing, the information concerning the condition for preventing the polishing object from slipping out is a relationship between the pressing force of the pressing unit and an upper limit of the pressing force of the retainer member at which the polishing object slips out, and the control unit acquires a current pressing force of the pressing unit during polishing of the surface to be polished, applies the current pressing force of the pressing unit to the relationship between the pressing force of the pressing unit and the upper limit of the pressing force of the retainer member at which the polishing object slips out, determines the upper limit of the pressing force of the retainer member at which the polishing object slips out, and controls the pressing force of the retainer member so that the pressing force of the retainer member exceeds the upper limit.

By doing so, the pressing force of the retainer member exceeds the upper limit of the pressing force of the retainer member at which the polishing object slips out, which makes it possible to prevent the polishing object from slipping out.

A polishing apparatus according to a fourteenth aspect of this technique, the polishing apparatus according to the first aspect, wherein the information concerning the force of friction between the surface to be polished of the polishing object and the polishing member is a setting value for a pressing force of the pressing unit, the information concerning the condition for preventing the polishing object from slipping out is a relationship between the pressing force of the pressing unit and an upper limit of the pressing force of the retainer member at which the polishing object slips out, and the control unit acquires the setting value for the pressing force of the pressing unit and a setting value for the pressing force of the retainer member, applies the setting value for the pressing force of the pressing unit to the relationship between the pressing force of the pressing unit and the upper limit of the pressing force of the retainer member at which the polishing object slips out, determines the upper limit of the pressing force of the retainer member at which the polishing object slips out, and executes control for informing in a case where the setting value for the pressing force of the retainer member is equal to or less than the upper limit.

By doing so, the operator is informed in the case where the setting value for the pressing force of the retainer member is equal to or less than the upper limit of the pressing force of the retainer member at which the polishing object slips out, allowing the operator to set the setting value for the pressing force of the retainer member to a value exceeding the upper limit. This makes it possible to prevent the polishing object from slipping out.

A polishing apparatus according to a fifteenth aspect of this technique, the polishing apparatus according to the first aspect, further comprising: a polishing table that holds the polishing member on a front surface thereof; a table rotary motor that rotates the polishing table; and wherein the information concerning the pressing force of the retainer member is a setting value for the pressing force of the retainer member, the information concerning the condition for preventing the polishing object from slipping out is a relationship between the pressing force of the retainer member and a lower limit of a rotary torque at which the polishing object slips out, and the control unit acquires the setting value for the pressing force of the retainer member, applies the acquired setting value for the pressing force of the retainer member to the relationship between the pressing force of the retainer member and the lower limit of the rotary torque at which the polishing object slips out, determines the lower limit of the rotary torque at which the polishing object slips out, compares the lower limit with a rotary torque of the table rotary motor during polishing of the surface to be polished, and performs a process depending on a comparison result.

By doing so, the control unit can control such that the rotary torque of the table rotary motor during polishing falls below the lower limit, which makes it possible to prevent the polishing object from slipping out.

A polishing apparatus according to a sixteenth aspect of this technique, the polishing apparatus according to the first aspect, wherein the condition for preventing the slipping-out is a condition that the pressing force of the retainer member is equal to or more than, or exceeds a threshold pressing force corresponding to the rotary torque of the table rotary motor in a virtual case where the retainer member is not pressed against the polishing member and the polishing object is pressed against the polishing member.

By doing so, the control unit can control the pressing force of the retainer member so that the polishing object does not slip out, which makes it possible to prevent the polishing object from slipping out.

A polishing apparatus according to a seventeenth aspect of this technique, the polishing apparatus according to the sixteenth aspect, wherein the condition for preventing the slipping-out is a condition that the pressing force of the retainer member is equal to or more than a value of a linear function of the rotary torque of the table rotary motor in the virtual case where the retainer member is not pressed against the polishing member and the polishing object is pressed against the polishing member.

By doing so, the control unit can control the pressing force of the retainer member to be equal to or more than the lower limit of the pressing force at which the polishing object does not slip out, which makes it possible to prevent the polishing object from slipping out.

A control method according to one aspect of this technique, A control method according to one aspect of this technique, a control method for executing control by way of referencing a storage unit that stores information concerning a condition for preventing an polishing object from slipping out, the condition being defined by use of information concerning a pressing force of a retainer member, the method comprising: a step of acquiring information concerning a force of friction between a surface to be polished of the polishing object and a polishing member, or the information concerning the pressing force of the retainer member; and a step of executing control for adapting to the condition for preventing the slipping-out by using the acquired information concerning the force of friction or the acquired information concerning the pressing force of the retainer member.

By doing so, the condition for preventing the polishing object from slipping out is not changed even if the process type or the polishing condition is varied, which makes it possible to prevent the polishing object from slipping out without depending on the process type or the polishing condition.

A recording medium according to one aspect of this technique, a recording medium storing therein in a non-transitory manner a program for executing control by way of referencing a storage unit that stores information concerning a condition for preventing an polishing object from slipping out, the condition being defined by use of information concerning a pressing force of a retainer member, the program causing a computer to execute: a step of acquiring information concerning a force of friction between a surface to be polished of the polishing object and a polishing member, or the information concerning the pressing force of the retainer member; and a step of executing control for adapting to the condition for preventing the slipping-out by using the acquired information concerning the force of friction or the acquired information concerning the pressing force of the retainer member.

By doing so, the condition for preventing the polishing object from slipping out is not changed even if the process type or the polishing condition is varied, which makes it possible to prevent the polishing object from slipping out without depending on the process type or the polishing condition.

FIG. 1 is a schematic view showing a general configuration of a polishing apparatus 10 according to an embodiment of this technique. As shown in FIG. 1, the polishing apparatus 10 includes a polishing table 100, and a top ring 1 as the substrate holder which holds a substrate such as a semiconductor wafer W and presses against a polishing surface on the polishing table 100, which is an example of the polishing object. The polishing table 100 is coupled with a table rotary motor 103 which is arranged on a lower side thereof via a table shaft 100*a*. The polishing table 100 is rotated about the table shaft 100*a* by the table rotary motor 103 being rotated. In other words, the table rotary motor 103 rotates the polishing table 100. A polishing pad 101 as the polishing member is attached to a top surface of the polishing table 100. In other words, the polishing table 100 holds the polishing member on the surface thereof. This surface of the polishing pad 101 constitutes a polishing surface 101*a* for polishing the semiconductor wafer W. Above the polishing table 100, a polishing liquid supply nozzle 60 is provided. A polishing liquid (polishing slurry) Q is supplied from this polishing liquid supply nozzle 60 onto the polishing pad 101 on the polishing table 100.

Note that examples of the polishing pad commercially available include various types such as SUBA800, IC-1000, and IC-1000/SUBA400 (two-layer cloth) manufactured by Nitta Haas Inc., and Surfin xxx-5 and Surfin 000 manufactured by Fujimi Incorporated. SUBA800, Surfin xxx-5, and Surfin 000 are a non-woven fabric made by solidifying fibers using a urethane resin, and IC-1000 is rigid expanded polyurethane (single layer). Expanded polyurethane is porous and has a lot of fine concaves or pores on a surface thereof.

The table rotary motor 103 is provided with a speed sensor 16 for detecting a rotary speed of a rotor of the table rotary motor 103. The speed sensor 16 can be constituted by a magnetic encoder, an optical encoder, a resolver, and the like. In the case of using the resolver, a resolver rotor is preferably connected directly to a rotor of an electric motor. When the resolver rotor rotates, a sin signal and a cos signal are obtained in a coil on a secondary side which is arranged to be shifted by 90°, and a rotor position of the table rotary motor 103 is detected based on these two kinds of signals, and then, the rotary speed of the table rotary motor 103 can be found by used of a differentiator.

The top ring 1 is basically configured by a top ring main body 2 for pressing the semiconductor wafer W against the polishing surface 101*a*, and a retainer ring 3 as the retainer member which holds a circumference of the semiconductor wafer W such that the semiconductor wafer W does not get out of the top ring 1. The top ring 1 is connected to a top ring shaft 111. This top ring shaft 111 moves up and down with respect to a top ring head 110 by means of an up-and-down motion mechanism 124. Positioning of the top ring 1 in an up-and-down direction is carried out by lifting and lowering entirely the top ring 1 with respect to the top ring head 110 by way of the up-and-down motion of the top ring shaft 111. The top ring shaft 111 has a rotary joint 25 attached to a top end thereof.

The up-and-down motion mechanism 124 for making the top ring shaft 111 and the top ring 1 move up and down includes a bridge 128 for rotatably supporting the top ring shaft 111 via a bearing 126, a ball screw 132 attached to the bridge 128, a support pedestal 129 supported by a pillar 130, and a servomotor 138 provided on the support pedestal 129. The support pedestal 129 supporting the servomotor 138 is fixed via the pillar 130 to the top ring head 110.

The ball screw 132 includes a threaded shaft 132*a* coupled with the servomotor 138, and a nut 132*b* screwed onto the threaded shaft 132*a*. The top ring shaft 111 moves up and down integrally with the bridge 128. Therefore, when the servomotor 138 is driven, the bridge 128 is moved up and down via the ball screw 132, which makes the top ring shaft 111 and the top ring 1 move up and down.

The top ring shaft 111 is coupled with a rotating cylinder 112 via a key (not shown). The rotating cylinder 112 has a timing pulley 113 on a circumference thereof. A rotary motor for top ring (pressing unit rotary motor) 114 is fixed to the top ring head 110, and the timing pulley 113 is coupled via a timing belt 115 to a timing pulley 116 provided to the rotary motor for top ring 114. Therefore, when the rotary motor for top ring 114 is rotatably driven, the rotating cylinder 112 and the top ring shaft 111 integrally rotate via the timing pulley 116, the timing belt 115, and the timing pulley 113 to rotate the top ring 1.

The top ring head 110 is supported by a top ring head shaft 117 which is rotatably supported by a frame (not shown). The polishing apparatus 10 is provided with a control unit 500 for controlling equipment in the apparatus including the rotary motor for top ring 114, the servomotor 138, and the table rotary motor 103. The control unit 500 acquires a rotary speed signal indicating the rotary speed of the table rotary motor 103 from the speed sensor 16. The polishing apparatus 10 is provided with an input unit 510 connected with the control unit 500 and receiving an input from the operator of the polishing apparatus 10, an informing unit 520 connected with the control unit 500, and a storage unit 530 connected with the control unit 500. The input unit 510 outputs an input signal indicating the received input to the control unit 500. The informing unit 520 informs information based on control by the control unit 500. The storage unit 530 stores information concerning the condition for preventing the polishing object from slipping out, the condition being defined by use of information concerning the pressing force of the retainer member. The control unit 500 acquires the information concerning the force of friction between the surface to be polished of the polishing object and the polishing member or the information concerning the pressing force of the retainer member and executes control for adapting to the condition stored in the storage unit 530 by using the acquired information concerning the force of friction or the acquired information concerning the pressing force of the retainer member.

Figure 2:
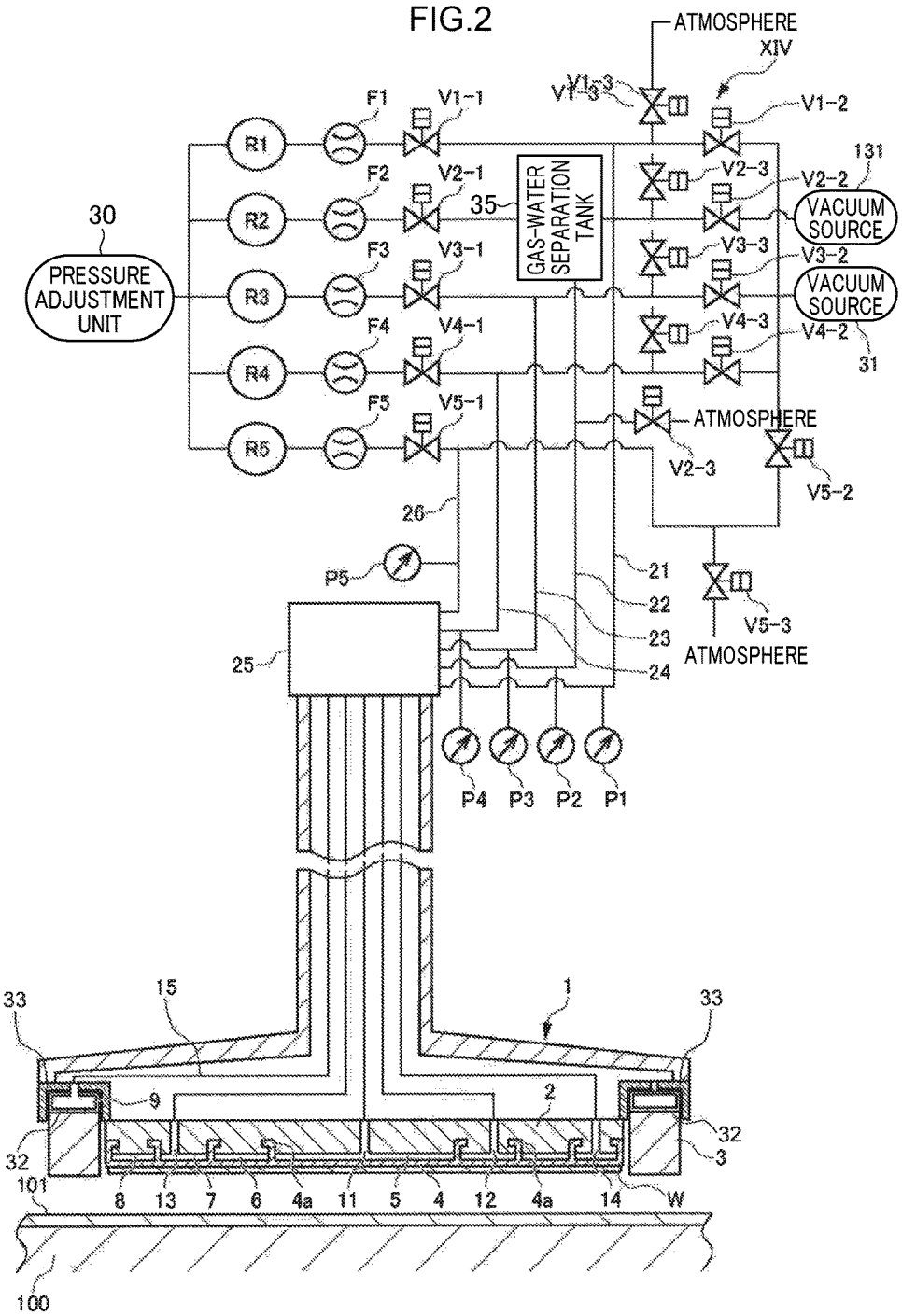
FIG. 2 is a schematic sectional view of the top ring 1 as the substrate holder which holds the semiconductor wafer as the polishing object and presses against the polishing surface on the polishing table 100.

Next, a description is given of the top ring (polishing head) 1 in the polishing apparatus according to this technique. FIG. 2 is a schematic sectional view of the top ring 1 as the substrate holder which holds the semiconductor wafer as the polishing object and presses against the polishing surface on the polishing table 100. FIG. 2 shows only main components constituting the top ring 1.

As shown in FIG. 2, the top ring 1 is basically configured by the top ring main body (also referred to as a carrier) 2 for pressing the semiconductor wafer W against the polishing surface 101*a*, and the retainer ring 3 as the retainer member which directly presses the polishing surface 101*a*. The top ring main body (carrier) 2 is formed of a substantially disc-shaped member, and the retainer ring 3 is attached to the circumference of the top ring main body 2. The top ring main body 2 is made of a resin such as engineering plastic (e.g., PEEK). The top ring main body 2 has an elastic membrane (membrane) 4 attached to a bottom surface thereof which corresponds to a back surface of the semiconductor wafer. The elastic membrane (membrane) 4 is made of a rubber member excellent in strength and durability such as ethylene-propylene rubber (EPDM), polyurethane rubber, and silicone rubber. The elastic membrane (membrane) 4 constitutes a substrate holding surface which holds the substrate such as the semiconductor wafer.

The elastic membrane (membrane) 4 has a plurality of concentric partition walls, and these partition walls 4a define a circular central chamber 5, an annular ripple chamber 6, an annular outer chamber 7, and an annular edge chamber 8 between a top surface of the membrane 4 and the bottom surface of the top ring main body 2. In other words, the central chamber 5 is formed at a center portion of the top ring main body 2, and the ripple chamber 6, the outer chamber 7, and the edge chamber 8 are formed in this order concentrically from the center toward the circumference. Formed in the top ring main body 2 are a passage 11 communicating with the central chamber 5, a passage 12 communicating with the ripple chamber 6, a passage 13 communicating with the outer chamber 7, and a passage 14 communicating with the edge chamber 8.

On the other hand, the passage 12 communicating with the ripple chamber 6 is coupled through the rotary joint 25 to a passage 22. The passage 22 is coupled through a gas-water separation tank 35, a valve V2-1, and a pressure regulator R2 to a pressure adjustment unit 30. The passage 22 is coupled through the gas-water separation tank 35 and a valve V2-2 to a vacuum source 131, and is communicable trough a valve V2-3 with the atmosphere.

A retainer ring pressure chamber 9 is formed by an elastic membrane (membrane) 32 also directly on the retainer ring 3. The elastic membrane (membrane) 32 is housed in a cylinder 33 fixed to a flange portion of the top ring 1. The retainer ring pressure chamber 9 is coupled through a passage 15 formed in the top ring main body (carrier) 2 and the rotary joint 25 to a passage 26. The passage 26 is coupled through a valve V5-1 and a pressure regulator R5 to the pressure adjustment unit 30. The passage 26 is also coupled through a valve V5-2 to a vacuum source 31 and is communicable through a valve V5-3 with the atmosphere.

The pressure regulators R1, R2, R3, R4, and R5 each have a pressure adjustment function to adjust a pressure of a pressure fluid which is supplied from the pressure adjustment unit 30 to the central chamber 5, the ripple chamber 6, the outer chamber 7, the edge chamber 8, and the retainer ring pressure chamber 9, respectively. The pressure regulators R1, R2, R3, R4, and R5, and the valves V1-1 to V1-3, V2-1 to V2-3, V3-1 to V3-3, V4-1 to V4-3, and V5-1 to V5-3 are connected with the control unit 500 (see FIG. 1) so that their actions are controlled. The passages 21, 22, 23, 24, and 26 are respectively provided with pressure sensors P1, P2, P3, P4, and P5, and flow rate sensors F1, F2, F3, F4, and F5.

The pressures of the fluids supplied to the central chamber 5, the ripple chamber 6, the outer chamber 7, the edge chamber 8, and the retainer ring pressure chamber 9 are adjusted independently from each other by the pressure adjustment unit 30 and the pressure regulators R1, R2, R3, R4, and R5. Such a structure allows the pressing force for pressing the semiconductor wafer W against the polishing pad 101 to be adjusted for each area on the semiconductor wafer W and allows the pressing force at which the retainer ring 3 presses the polishing pad 101 to be adjusted.

A description is given of a polishing operation performed by the polishing apparatus configured as above. The top ring 1 receives the semiconductor wafer W from a substrate transfer device (pusher) not shown and holds on its bottom surface the semiconductor wafer W by vacuum suction. At this time, the top ring 1 holds the semiconductor wafer W with the surface to be polished (usually, a surface on which the device is formed, also referred to as a "front surface") being directed downward such that the surface to be polished faces the front surface of polishing pad 101. The top ring 1 holding the semiconductor wafer Won its bottom surface is moved from a position to receive the semiconductor wafer W to a position above the polishing table 100 by the top ring head 110 pivoting by way of the rotation of the top ring head shaft 117.

Then, the top ring 1 holding the semiconductor wafer W by vacuum suction is lowered to a setting position for polishing of the top ring which is preset. At this setting position for polishing, the retainer ring 3 is in contact with the front surface (polishing surface) 101*a* of the polishing pad 101, but before polishing, since the top ring 1 holds the semiconductor wafer W by suction, there is a small gap (e.g., about 1 mm) between the bottom surface (surface to be polished) of the semiconductor wafer W and the front surface (polishing surface) 101*a* of the polishing pad 101. At this time, both the polishing table 100 and the top ring 1 are rotatably driven, and the polishing liquid is supplied onto the polishing pad 101 from the polishing liquid supply nozzle 60 provided above the polishing table 100.

In this state, the elastic membrane (membrane) 4 on the back surface side of the semiconductor wafer W is expanded to press the back surface of the surface to be polished of the semiconductor wafer W so as to press the surface to be polished of the semiconductor wafer W against the front surface (polishing surface) 101*a* of the polishing pad 101, and the surface to be polished of the semiconductor wafer W and the polishing surface of the polishing pad 101 are slid relative to each other to polish the surface to be polished of the semiconductor wafer W until a predetermined state is obtained (e.g., a predetermined membrane thickness) by use of the polishing surface 101*a* of the polishing pad 101. After completion of a wafer processing process on the polishing pad 101, the semiconductor wafer W is attached to the top ring 1 by suction, and the top ring 1 is lifted up and moved to the substrate transfer device constituting a substrate transferring mechanism to release the semiconductor wafer W.

Figure 3:
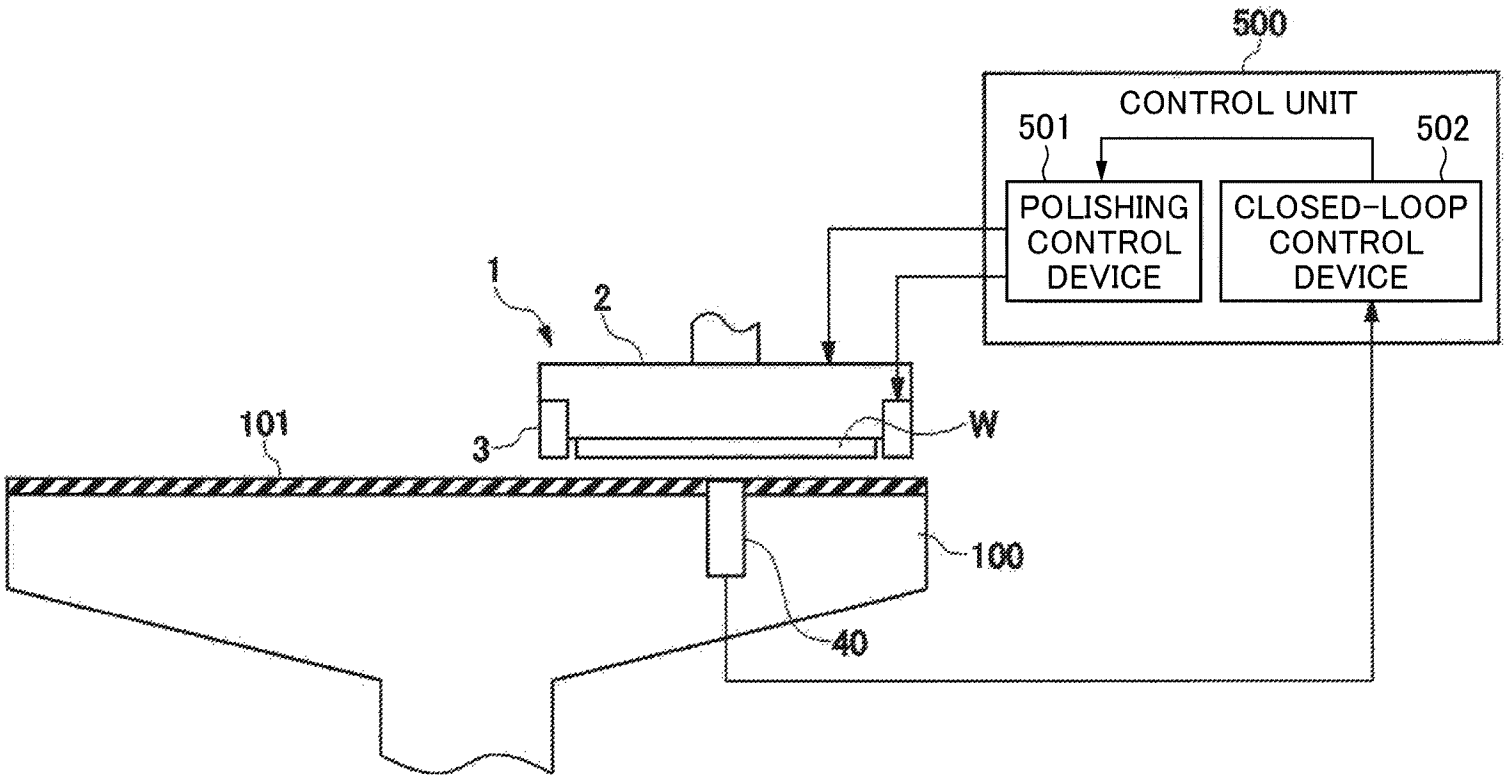
FIG. 3 is a diagram showing a configuration of the polishing apparatus 10 for controlling the polishing operation.

FIG. 3 is a diagram showing a configuration of the polishing apparatus 10 for controlling the polishing operation. The control unit 500 includes a polishing control device 501 and a closed-loop control device 502.

When the polishing apparatus 10 starts polishing, a thickness measurement unit 40 estimates (or measures) a residual thickness profile to output an estimated value (or measured value) to the closed-loop control device 502. The closed-loop control device 502 determines whether or not the residual thickness profile becomes a targeted thickness profile (hereinafter, referred to as a targeted profile). If the residual thickness profile estimated by the thickness measurement unit 40 becomes the targeted profile, the polishing process ends. Here, the targeted profile may be a complete flat shape (having the uniform thickness across the entire plane) or a shape having irregularities or inclinations.

The estimated residual thickness profile does not become the targeted profile, the closed-loop control device 502 calculates, based on the estimated residual thickness profile, pressure instruction values (pressure parameters) for the fluids to be supplied to the central chamber 5, the ripple chamber 6, the outer chamber 7, the edge chamber 8, and the retainer ring pressure chamber 9 (hereinafter, collectively referred to as a "pressure chamber") to output a CLC signal indicating these pressure instruction values to the polishing control device 501. The polishing control device 501 adjusts the pressures of the fluids supplied to the respective pressure chambers in accordance with the pressure instruction values indicated by the CLC signal. The polishing apparatus 10 repeats the above steps at a certain cycle until the estimated residual thickness profile becomes the targeted thickness profile. Note that the pressure chamber, which corresponds to the pressing unit according to this technique, is rotated by the rotary motor for top ring (pressing unit rotary motor) 114. The retainer ring 3 presses the polishing pad 101 in the vicinity of the pressing unit.

Figure 4B:
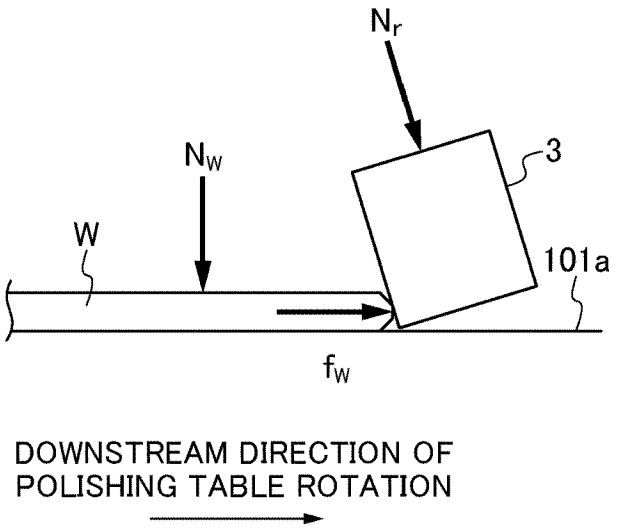
FIG. 4B is a schematic sectional view showing a part of the top ring 1 according to an embodiment of this technique on an enlarged scale.
Figure 4A:
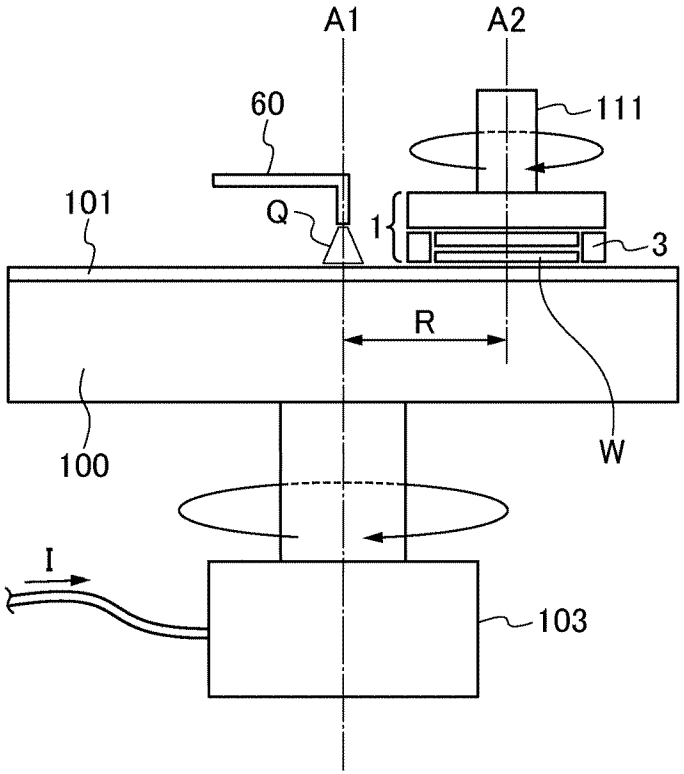
FIG. 4A is a schematic sectional view showing a configuration of a part of the polishing apparatus according to an embodiment of this technique.

Subsequently, a description is given of a case where the semiconductor wafer W slips out with reference to FIGS. 4A and 4B. FIG. 4A is a schematic sectional view showing a configuration of a part of the polishing apparatus according to an embodiment of this technique. As shown in FIG. 4A, a current I is applied to the table rotary motor 103. A distance between a rotational axis Al of the polishing table 100 and a rotational axis A2 of the top ring 1 is designated by R. Then, a total table rotary torque $T_t$ at a position apart by a distance R from the rotational axis Al of the polishing table 100 is represented by the next formula (1).

$$T_t = R \times (\mu_W N_W + \mu_r N_r) \quad (1)$$

Here, $N_W$ is a pressing load of the semiconductor wafer W, $N_r$ is a pressing load of the retainer ring 3, $\mu_W$ is a coefficient of friction with respect to the semiconductor wafer W, $\mu_r$ is a coefficient of friction between the retainer ring 3 and the polishing pad 101. FIG. 4B is a schematic sectional view showing a part of the top ring 1 according to an embodiment of this technique on an enlarged scale. As shown in FIG. 4B, the semiconductor wafer W is applied with the force of friction $f_W(=\mu_W N_W)$ of the semiconductor wafer W in a radial direction of the polishing table 100. This makes the retainer ring 3 to be pushed by the force of friction $f_W$ of the semiconductor wafer W in the radial direction of the polishing table 100, and therefore, if the pressing load $N_r$ of the retainer ring 3 is insufficient, the semiconductor wafer W slips out.

Figure 5A:
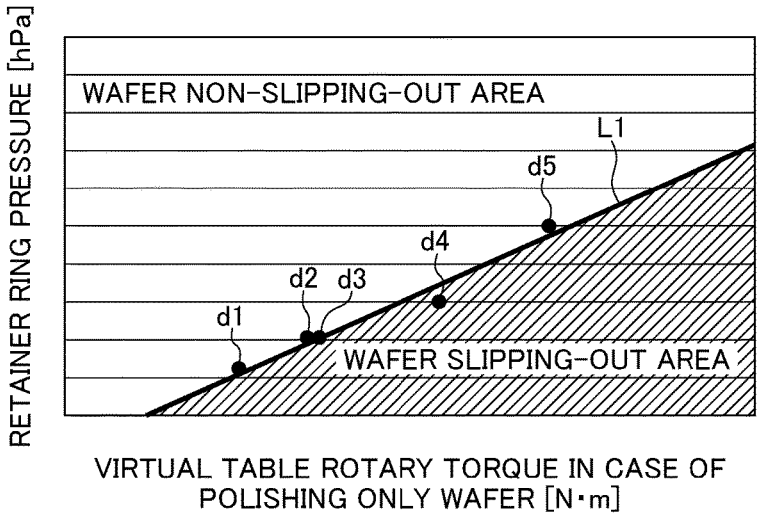
FIG. 5A is an exemplary graph showing a relationship between the rotary torque of the polishing table 100 and the RRP lower limit in a case of polishing with only the semiconductor wafer W being brought into contact with the polishing pad 101.
Figure 5B:
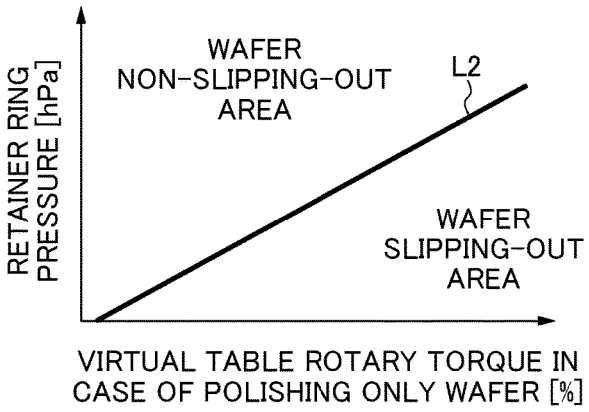
FIG. 5B is an exemplary graph in a case of an abscissa representing in percentage in FIG. 5A.

FIG. 5A is an exemplary graph showing a relationship between the rotary torque of the polishing table 100 and the RRP lower limit in a case of polishing with only the semiconductor wafer W being brought into contact with the polishing pad 101. Polishing with only the semiconductor wafer W being brought into contact with the polishing pad 101 corresponds to polishing with the retainer ring 3 or the like (including a dress if the dress exists) being not in contact with the polishing pad 101 and the semiconductor wafer W being brought contact with the polishing pad 101. FIG. 5B is an exemplary graph in a case of an abscissa representing in percentage in FIG. 5A.

The present inventors have found that as the retainer ring pressure is decreased under a control of maintaining a rotation frequency of the polishing table 100 and the rotation frequency of the top ring 1 to be respectively constant, a positive correlation is seen between the rotary torque of the polishing table 100 in the case of polishing only the semiconductor wafer W (hereinafter, also referred to as a table rotary torque) and the RRP lower limit as shown in FIG. 5A. Here, points d1 to d5 represent virtual table rotary torques and the RRP lower limits in the case of polishing only the semiconductor wafer W which were obtained by actually performing a polishing test. A straight line L1 shown in FIG. 5A is an approximate straight line obtained by approximating the points d1 to d5 by use of a least-squares technique, and has a relational expression represented by RRP lower limit=$0.74 \times T_w - 34.83$. Here, $T_w$ is the virtual table rotary torque in the case of polishing only the wafer. An area below the straight line L1 shown in FIG. 5A as a boundary is a wafer slipping-out area where the semiconductor wafer W slips out. On the other hand, an area above the straight line L1 shown in FIG. 5A as the boundary is an area where the semiconductor wafer W does not slip out. As can be seen from the above, there is a linear relationship between the virtual table rotary torque and the RRP lower limit in the case of polishing only the semiconductor wafer W. This relationship never changes even if the process type and the polishing condition are varied.

Note that if a position of a gravity center of the top ring (polishing head) 1 is changed, ease of inclination of the retainer ring 3 is changed to change ease of slipping-out of the semiconductor wafer W. For this reason, if the gravity center of the top ring (polishing head) 1 is changed, a slope and/or intercept of the above linear function may be possibly changed. For example, if the gravity center of the top ring (polishing head) 1 is increased, the retainer ring 3 is likely to be inclined, and thus, the intercept of the linear function is set to larger than −34.83. In this way, the above linear function is set depending on the gravity center of the top ring (polishing head) 1.

The intercept of the linear function may be set to larger than −34.83 by a predetermined value (e.g., a value in a range of 100 hPa or less), for example, to provide a margin on the RRP lower limit.

In this way, the condition for preventing the slipping-out may be set to a condition that the retainer ring pressure is equal to or more than a value, as a variable, of a linear function of the virtual table rotary torque in the case of polishing only the wafer. The condition is not limited to using the linear function, but may be determined by the control unit 500 referencing a table which is stored in the storage unit 530 and associated with a combination of the virtual table rotary torque and a threshold pressing force in the case of polishing only the wafer. In other words, a relationship between the virtual table rotary torque and the threshold pressing force in the case of polishing only the wafer may be stored in a form of a linear function, a table or the like in the storage unit 530, and the control unit 500 may reference this relationship. Here, the threshold pressing force may be the RRP lower limit or a value of the RRP lower limit plus a predetermined value as a margin. Then, the condition for preventing the slipping-out may be a condition that the pressing force of the retainer member is equal to or more than the threshold pressing force corresponding to the virtual table rotary torque in the case of polishing only the wafer.

The threshold pressing force may be the upper limit of the pressing force of the retainer ring in the case of the slipping-out. In this case, the condition for preventing the slipping-out may be a condition that the pressing force of the retainer member exceeds the threshold pressing force corresponding to the virtual table rotary torque in the case of polishing only the wafer.

Since the rotary torque of the polishing table 100 is proportional to a table current value, there is a linear relationship also between the table current value and the RRP lower limit. Here, a value of the current applied to the table rotary motor 103 is referred to as a table current value. The table current value Iw in the case of assuming that the retainer ring 3 is not in contact with the polishing pad 101 and only the semiconductor wafer W is brought into contact with the polishing pad 101 to polish at a predetermined rotation frequency (hereinafter, also referred to as the table current value in the case of polishing only the wafer) is represented by the next formula (2). Note that a situation where the retainer ring 3 is not in contact with the polishing pad 101 and only the semiconductor wafer W is polished is actually impossible in an experiment, and therefore, this table current value Iw in the case of polishing only the wafer is merely a computational or virtual value.

$$It=Iw+Ir+Id \quad (2)$$

Here, It is a table current value when all of the polishing pad 101, the retainer ring 3 and the dress are polished at a predetermined rotation frequency the same as the above. Ir is a table current value when only the retainer ring 3 is brought into contact with the polishing pad 101 and polished at a predetermined rotation frequency the same as the above (hereinafter, also referred to as the table current value in the case of polishing only the retainer ring). Id is a table current value when only the dress not shown is brought into contact with the polishing pad 101 and polished at a predetermined rotation frequency the same as the above (hereinafter, also referred to as the table current value in the case of polishing only the dress). The formula (2) is modified to obtain the next formula (3).

$$Iw=It-(Ir+Id) \quad (3)$$

From the formula (2), data is prepared in advance by performing polishing respectively as for the table current value Ir in the case of polishing only the retainer ring and the table current value Id in the case of polishing only the dress. This allows the table current value It at the time of polishing to be acquired at the time of polishing, which makes it possible to determine the table current value Iw in the case of polishing only the wafer. Then, in terms of the relationship between the table current value in the case of polishing only the semiconductor wafer W and the RRP lower limit, the RRP lower limit corresponding to this table current value Iw in the case of polishing only the wafer is acquired to allow the RRP lower limit to be determined. Since the relationship between the table rotary torque in the case of polishing only the semiconductor wafer W and the RRP lower limit is not changed even if the process type and the polishing condition are varied, the RRP lower limit can be determined from the table current value It at the time of polishing independently from the process type and the polishing condition.

Based on this, the control unit 500 may determine, for example, the table current value Iw in the case of polishing only the wafer from the table current value It at the time of polishing, and apply the pressing force of the retainer ring 3 during polishing and the table current value Iw in the case of polishing only the wafer to the condition for not slipping out the semiconductor wafer W to control the pressing force of the retainer ring 3 such that the pressing force of the retainer ring 3 during polishing is kept to be equal to or more than the RRP lower limit.

In this way, the parameter for establishing the linear relationship with the RRP lower limit is not limited only to the rotary torque of the polishing table 100 in the case of polishing only the semiconductor wafer W (hereinafter, referred as the table rotary torque in the case of polishing only the wafer) or the table current value Iw in the case of polishing only the wafer.

The parameters include also the force of friction between the surface to be polished and the polishing pad 101 (that is the force of friction between the surface to be polished and the polishing member), or the current value of the table rotary motor 103 (hereinafter, also referred to as the table current value), and the rotary torque of the pressing unit or the current value of the rotary motor for top ring (pressing unit rotary motor) 114.

In consideration of these, the control unit 500 may control the pressing force of the retainer member so as to adapt to the condition for preventing the slipping-out depending on the information concerning the force of friction between the surface to be polished of the polishing object and the polishing member during polishing. By doing so, the condition for preventing the slipping-out is not changed even if the process type or the polishing condition is varied, which makes it possible to prevent the polishing object from slipping out without depending on the process type or the polishing condition.

More specifically, the control unit 500 references the relationship between the RRP lower limit and the information concerning the force of friction between the surface to be polished of the polishing object and the polishing member and controls the pressing force of the retainer member during polishing to be equal to or more than the RRP lower limit corresponding to the information concerning the force of friction between the surface to be polished of the polishing object and the polishing member during polishing. By doing so, the pressing force of the retainer member is set to be equal to or more than the lower limit of the pressing force of the retainer member at which no slipping-out occurs, which makes it possible to prevent the polishing object from slipping out without depending on the process type or the polishing condition.

Here, the information concerning the force of friction between the surface to be polished of the polishing object and the polishing member on which the control unit 500 depends in controlling the pressing force of the retainer member is the force of friction between the surface to be polished and the polishing member, the rotary torque of the polishing table 100 or the current value of the table rotary motor, or the rotary torque of the pressing unit or the current value of the pressing unit rotary motor. In this way, the information concerning the force of friction between the surface to be polished of the polishing object and the polishing member includes not only the force of friction between the surface to be polished and the polishing member but also the rotary torque of the polishing table or the current value of the table rotary motor, or the rotary torque of the pressing unit or the current value of the pressing unit rotary motor.

EXAMPLE 1

Figure 6A:
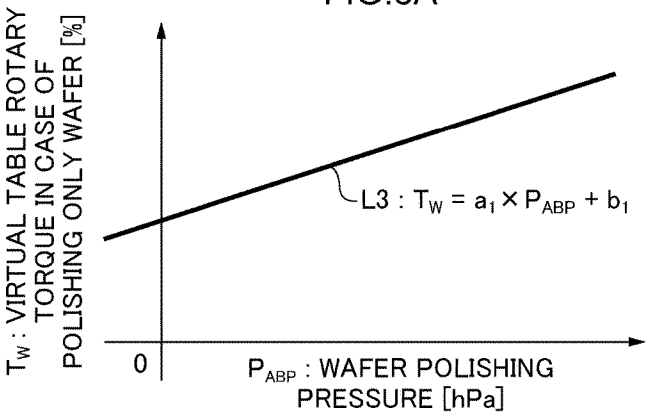
FIG. 6A is an exemplary graph showing a relationship between a wafer polishing pressure $P_{ABP}$ and the virtual table rotary torque $T_w$ in the case of polishing only the wafer.

Subsequently, a description is given of Example 1 according to the embodiment. A description is given of a method for deciding the lower limit of the retainer ring pressure at which no slipping-out occurs with reference to FIGS. 6A to 6C. FIG. 6A is an exemplary graph showing a relationship between a wafer polishing pressure $P_{ABP}$ and the virtual table rotary torque $T_w$ in the case of polishing only the wafer. As shown by a straight line L3 in FIG. 6A, the wafer polishing pressure $P_{ABP}$ and the virtual table rotary torque $T_w$ in the case of polishing only the wafer have a linear relationship. The virtual table rotary torque $T_w$ in the case of polishing only the wafer is represented by the next formula (4).

$$T_w=a_1\times P_{ABP}+b_1 \quad (4)$$

Here, $a_1$ is a coefficient representing a slope, and $b_1$ is a coefficient representing an intercept. Since these coefficients $a_1$ and $b_1$ vary if the coefficient of friction of the polishing surface 101*a* changes, the coefficients need to be anew acquired in the case where the coefficient of friction of the polishing surface 101*a* may possibly change. The case where the coefficient of friction of the polishing surface 101*a* may possibly change is, for example, a case where the polishing pad 101, a slurry type, a slurry flow rate, a wafer film type, a retainer ring groove, a retainer ring width or the like is changed.

Figure 6B:
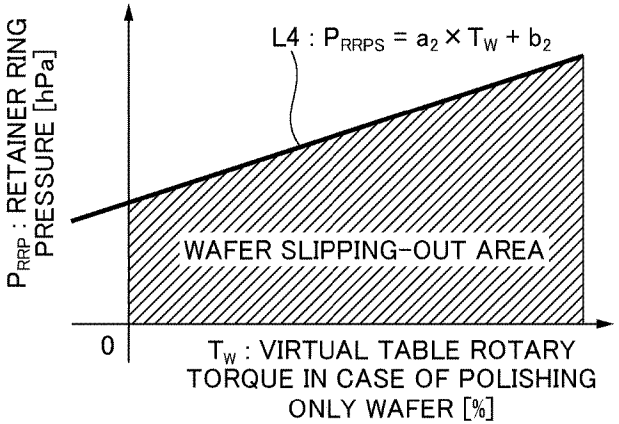
FIG. 6B is an exemplary graph showing a relationship between an RRP lower limit $P_{RRPS}$ and the virtual table rotary torque $T_w$ in the case of polishing only the wafer.

FIG. 6B is an exemplary graph showing a relationship between an RRP lower limit $P_{RRPS}$ and the virtual table rotary torque $T_w$ in the case of polishing only the wafer. An ordinate represents the retainer ring pressure $P_{RRP}$, and an abscissa represents the virtual table rotary torque $T_w$ in the case of polishing only the wafer. As shown by a straight line L4 in FIG. 6B, the RRP lower limit $P_{RRPS}$ and the table rotary torque $T_w$ in the case of polishing only the wafer have a linear relationship as is illustrated also in FIG. 5B. An area below the straight line L4 in FIG. 6B is the wafer slipping-out area. The RRP lower limit $P_{RRPS}$ is represented by the next formula (5).

$$P_{RRPS}=a_2\times T_w+b_2 \tag{5}$$

Here, $a_2$ is a coefficient representing a slope, and $b_2$ is a coefficient representing an intercept. These coefficients $a_2$ and $b_2$ do not vary even if the coefficient of friction of the polishing surface 101*a* changes.

If $T_w$ of the formula (4) is substituted into the formula (5), the RRP lower limit $P_{RRPS}$ is represented by the next formula (6).

$$P_{RRPS} = a_2\times T_w+b_2 = a_2\times(a_1\times P_{ABP}+b_1)+b_2 = a_1a_2\times P_{ABP}+a_2b_1+b_2 \tag{6}$$

Figure 6C:
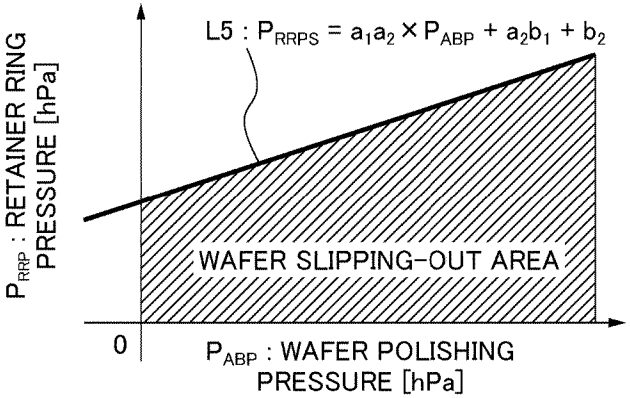
FIG. 6C is an exemplary graph showing a relationship between the wafer polishing pressure $P_{ABP}$ and the RRP lower limit $P_{RRPS}$.

As seen from the formula (6), the RRP lower limit $P_{RRPS}$ is proportional to the wafer polishing pressure $P_{ABP}$. FIG. 6C is an exemplary graph showing a relationship between the wafer polishing pressure $P_{ABP}$ and the RRP lower limit $P_{RRPS}$. An ordinate represents the RRP lower limit $P_{RRPS}$, and an abscissa represents the wafer polishing pressure $P_{ABP}$. An area below a straight line L5 in FIG. 6C is the wafer slipping-out area.

Figure 7:
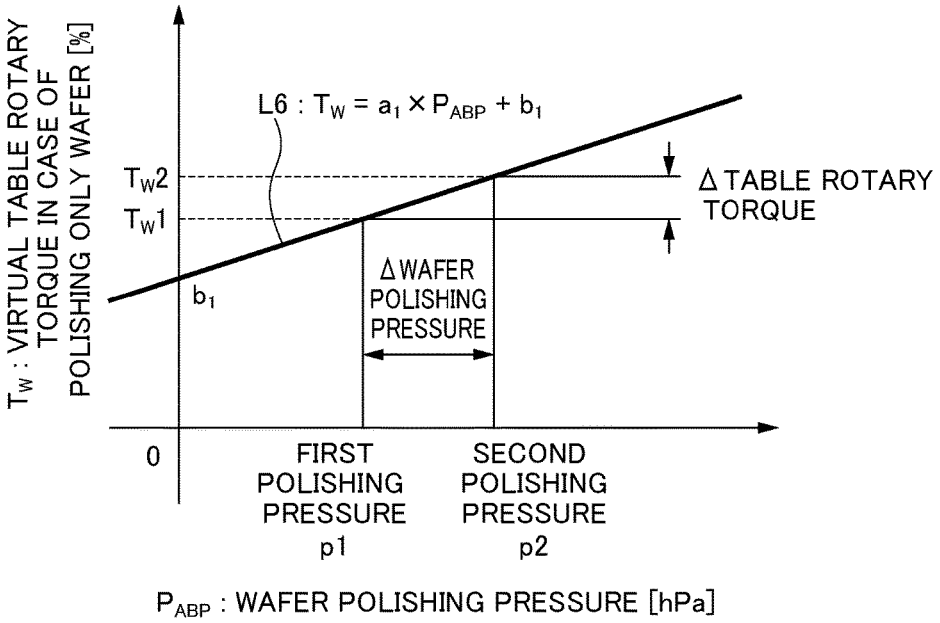
FIG. 7 is an exemplary graph showing a relationship between the wafer polishing pressure $P_{ABP}$ and the virtual table rotary torque $T_w$ in the case of polishing only the wafer.

Subsequently, a description is given of a method for deciding the coefficient $a_1$ and the coefficient $b_1$ of the formula (4). FIG. 7 is an exemplary graph showing a relationship between the wafer polishing pressure $P_{ABP}$ and the virtual table rotary torque $T_w$ in the case of polishing only the wafer. Here, the total table rotary torque $T_t$ is a sum of the virtual table rotary torque Tw in the case of polishing only the wafer and the table rotary torque $T_r$ in the case of polishing only the retainer ring ($T_t=T_w+T_r$). A straight line L6 shown in FIG. 7 is represented by the formula (4), and, from the above described relationship of $T_t=T_w+T_r$, the coefficient $a_1$ of the formula (4) is represented by Δtable rotary torque/Δwafer polishing pressure=$(T_w\mathbf{2}-T_w\mathbf{1})/(\mathbf{p2}-\mathbf{p1})=((T_t\mathbf{2}-Tr)-(T_t\mathbf{1}-Tr))/(\mathbf{p2}-\mathbf{p1})=(T_t\mathbf{2}-T_t\mathbf{1})/(\mathbf{p2}-\mathbf{p1})$. This allows the coefficient $a_1$ to be determined by acquiring a total table rotary torque $T_t\mathbf{1}$ in a case of polishing the wafer at a first polishing pressure p1 and by acquiring a total table rotary torque $T_t\mathbf{2}$ in a case of polishing the wafer at a second polishing pressure p2. The coefficient $b_1$ is a table rotary torque in no-load idle rotation. Here, in the embodiment, the membrane is a multi-area membrane having a plurality of areas, and therefore, the wafer polishing pressure is an average of all in-area pressures. Note that if the membrane is a single-area membrane including one area, the wafer polishing pressure is the in-area pressure.

Figure 8:
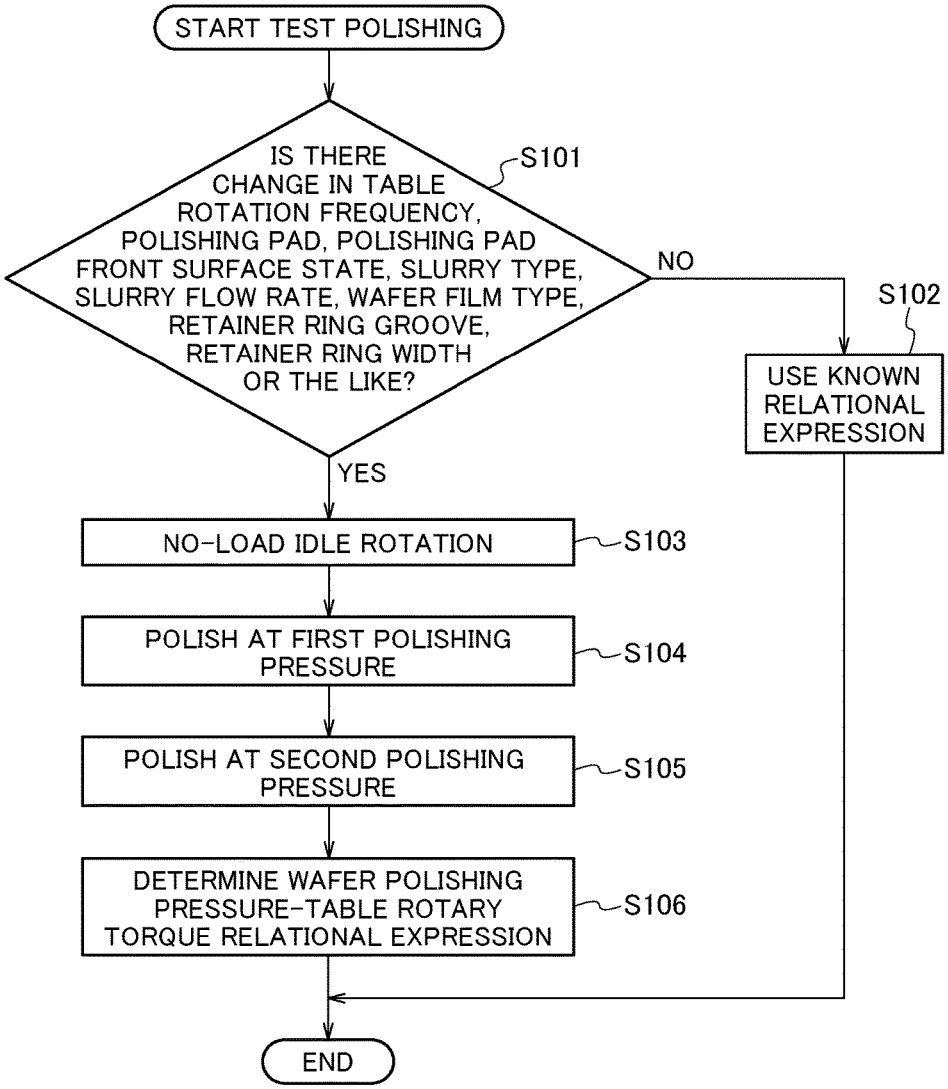
FIG. 8 is a flowchart showing an example of a process in test polishing according to Example 1.

FIG. 8 is a flowchart showing an example of a process in test polishing according to Example 1. In this test polishing, acquired is the relationship between the wafer polishing pressure $P_{ABP}$ and the virtual table rotary torque $T_w$ in the case of polishing only the wafer.

(Step S101) The control unit 500 determines whether or not there is a change in the table rotation frequency, the polishing pad 101, a polishing pad front surface state, the slurry type, the slurry flow rate, the wafer film type, the retainer ring groove, the retainer ring width or the like. If there is some change here, this is the case where the coefficient of friction may possibly change.

(Step S102) If it is determined at step S101 that there is no change in the table rotation frequency, the polishing pad 101, the polishing pad front surface state, the slurry type, the slurry flow rate, the wafer film type, the retainer ring groove, the retainer ring width or the like, the control unit 500 uses the known relational expression for the wafer polishing pressure $P_{ABP}$ and the table rotary torque $T_w$ in the case of polishing only the wafer (Step S103) If it is determined at step S101 that there is a change in the table rotation frequency, the polishing pad 101, the polishing pad front surface state, the slurry type, the slurry flow rate, the wafer film type, the retainer ring groove, the retainer ring width or the like, the control unit 500 controls the polishing table 100 to be rotated at a predetermined speed in no-load idle rotation. Then, the control unit 500 acquires the table rotary torque $T_w$ at this time as the coefficient $b_1$.

(Step S104) Next, the control unit 500 presses the semiconductor wafer W at the first polishing pressure p1 while it rotates the polishing table 100 at a predetermined speed, with a state where both the semiconductor wafer W and the retainer ring 3 are brought into contact with the polishing pad 101. Then, the control unit 500 acquires the total table rotary torque $T_t\mathbf{1}$ at this time.

(Step S105) Next, the control unit 500 presses the semiconductor wafer W at the second polishing pressure p2 while it rotates the polishing table 100 at a predetermined speed, with a state where both the semiconductor wafer W and the retainer ring 3 are brought into contact with the polishing pad 101. Then, the control unit 500 acquires the total table rotary torque $T_t\mathbf{2}$ at this time.

(Step S106) Then, the control unit 500 calculates the coefficient $a_1(=(T_w\mathbf{2}-T_w\mathbf{1})/(\mathbf{p2}-\mathbf{p1}))$ (however, $T_w\mathbf{2}-T_w\mathbf{1}=(T_t\mathbf{2}-T_r)-(T_t\mathbf{1}-T_r)$ from $T_t=T_w+T_r$). This allows the relational expression to be determined for the wafer polishing pressure $P_{ABP}$ and the table rotary torque $T_w$ in the case of polishing only the wafer (that is, the formula (4) is determined). Then, the control unit 500 updates and stores the coefficient $a_1$ and the coefficient $b_1$. By doing so, the coefficient $a_1$ and the coefficient $b_1$ are updated, which also updates the formula (6).

Figure 9:
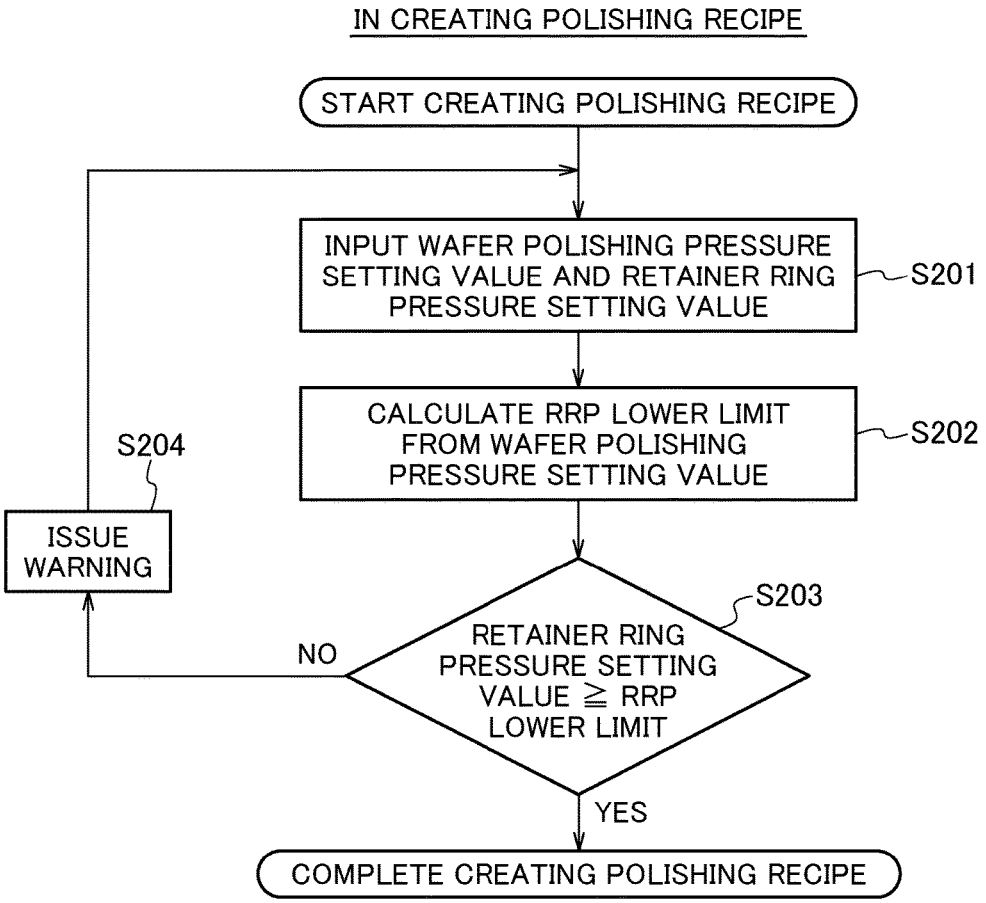
FIG. 9 is a flowchart showing an example of a process in creating a polishing recipe.

FIG. 9 is a flowchart showing an example of a process in creating a polishing recipe.

(Step S201) The input unit 510 receives the input of the wafer polishing pressure setting value and retainer ring pressure setting value and outputs to control unit 500 the input signal including the received wafer polishing pressure setting value and retainer ring pressure setting value.

(Step S202) Next, the control unit 500 substitutes the wafer polishing pressure setting value into the formula (6), and calculates the lower limit (RRP lower limit) $P_{RRPS}$ of the retainer ring pressure at which the semiconductor wafer W does not slip out in accordance with the formula (6).

(Step S203) Next, the control unit 500 determines whether or not the retainer ring pressure setting value received at step S201 is equal to or more than the RRP lower limit $P_{RRPS}$. If the control unit 500 determines that the retainer ring pressure setting value is equal to or more than the RRP lower limit $P_{RRPS}$, it ends creating the polishing recipe because the semiconductor wafer W is not spilled out at that retainer ring pressure setting value.

(Step S204) On the other hand, if it is determined at step S203 that the retainer ring pressure setting value is not equal to or more than the RRP lower limit $P_{RRPS}$ (that is, the retainer ring pressure setting value is less than the RRP lower limit $P_{RRPS}$), the control unit 500 issues a warning. For example, the control unit 500 displays, in a display unit not shown, information for prompting to input a value equal to or more than RRP lower limit $P_{RRPS}$ because the semiconductor wafer W slips out at the input retainer ring pressure setting value. After that, at step S201, the input unit 510 receives again an input of the wafer polishing pressure setting value and retainer ring pressure setting value.

As described above, those illustrated in FIG. 9 is summarized as that the storage unit 530 stores therein the relationship between the pressing force of the pressing unit and the lower limit of the pressing force of the retainer member at which the polishing object does not slip out. Note that this relationship is not limited to the relational expression buy may be a table or the like. Then, the control unit 500 acquires the setting value for the pressing force of the pressing unit and the setting value for the pressing force of the retainer member, applies the setting value for the pressing force of the pressing unit to the "relationship between the pressing force of the pressing unit and the lower limit of the pressing force of the retainer member at which the polishing object does not slip out" stored in the storage unit 530, determines the lower limit of the pressing force of the retainer member at which the polishing object does not slip out, and executes control for informing in the case where the setting value for the pressing force of the retainer member falls below the lower limit.

By doing so, the operator is informed in the case where the setting value for the pressing force of the retainer member falls below the lower limit of the pressing force of the retainer member at which the polishing object does not slip out, allowing the operator to set the setting value for the pressing force of the retainer member to a value equal to or more than the lower limit. This makes it possible to prevent the polishing object from slipping out.

In addition, the relationship between the pressing force of the pressing unit and the lower limit of the pressing force of the retainer member at which the polishing object does not slip out (see the relationship in FIG. 6C) is determined based on a relationship between the information concerning the force of friction between the surface to be polished of the polishing object and the polishing member and the lower limit of the pressing force of the retainer member at which the polishing object does not slip out (see the relationship in FIG. 6B) as well as a relationship between the information concerning the force of friction between the surface to be polished of the polishing object and the polishing member and the pressing force of the pressing unit (wafer polishing pressure) (see the relationship in FIG. 6A) in a virtual case where the retainer member is not pressed against the polishing member and the polishing object is pressed against the polishing member.

This defines a relationship between a pressing force of a pressing unit and the lower limit of the pressing force of the retainer member at which the polishing object does not slip out.

As described in FIG. 8, the control unit 500 acquires, when the coefficient of friction between the surface to be polished and the polishing member may possibly change (in the case of YES at step S101 in FIG. 8), a relationship between the "information concerning the force of friction between the surface to be polished of the polishing object and the polishing member" and the pressing force of the pressing unit (see the relationship in FIG. 6A) (see steps S103 to S106 in FIG. 8) in the virtual case where the retainer member is not pressed against the polishing member and the polishing object is pressed against the polishing member, is acquired. Then, the control unit 500 updates the relationship between the pressing force of the pressing unit and the lower limit of the pressing force of the retainer member at which the polishing object does not slip out (see the relationship in FIG. 6C) by using the acquired relationships.

By doing so, every time the coefficient of friction between the surface to be polished and the polishing member may possibly change, updated is the relationship between the pressing force of the pressing unit and the lower limit of the pressing force of the retainer member at which the polishing object does not slip out.

Here, the "information concerning the force of friction between the surface to be polished of the polishing object and the polishing member" is the force of friction between the surface to be polished and the polishing member, the rotary torque of the polishing table or the current value of the table rotary motor, or the rotary torque of the pressing unit or the current value of the pressing unit rotary motor. In this way, the information concerning the force of friction between the surface to be polished of the polishing object and the polishing member includes not only the force of friction between the surface to be polished and the polishing member but also the rotary torque of the polishing table or the current value of the table rotary motor, or the rotary torque of the pressing unit or the current value of the pressing unit rotary motor.

Note that the control unit 500 uses the relationship between the pressing force of the pressing unit and the "lower limit" of the pressing force of the retainer member at which the polishing object "does not slip out", but, not limited thereto, may use the relationship between the pressing force of the pressing unit and the "upper limit" of the pressing force of the retainer member at which the polishing object "slips out". In this case, the storage unit 530 stores therein the relationship between the pressing force of the pressing unit and the upper limit of the pressing force of the retainer member at which the polishing object slips out. Note that this relationship is not limited to the relational expression buy may be a table or the like. Then, the control unit 500 may acquire the setting value for the pressing force of the pressing unit and the setting value for the pressing force of the retainer member, apply the setting value for the pressing force of the pressing unit to the "relationship between the pressing force of the pressing unit and the upper limit of the pressing force of the retainer member at which the polishing object does not slip out" stored in the storage unit 530, determine the upper limit of the pressing force of the retainer member at which the polishing object slips out, and execute control for informing in the case where the setting value for the pressing force of the retainer member is equal to or less than the upper limit.

By doing so, the operator is informed in the case where the setting value for the pressing force of the retainer member is equal to or less than the upper limit of the pressing force of the retainer member at which the polishing object slips out, allowing the operator to set the setting value for the pressing force of the retainer member to a value exceeding the upper limit. This makes it possible to prevent the polishing object from slipping out.

Figure 10:
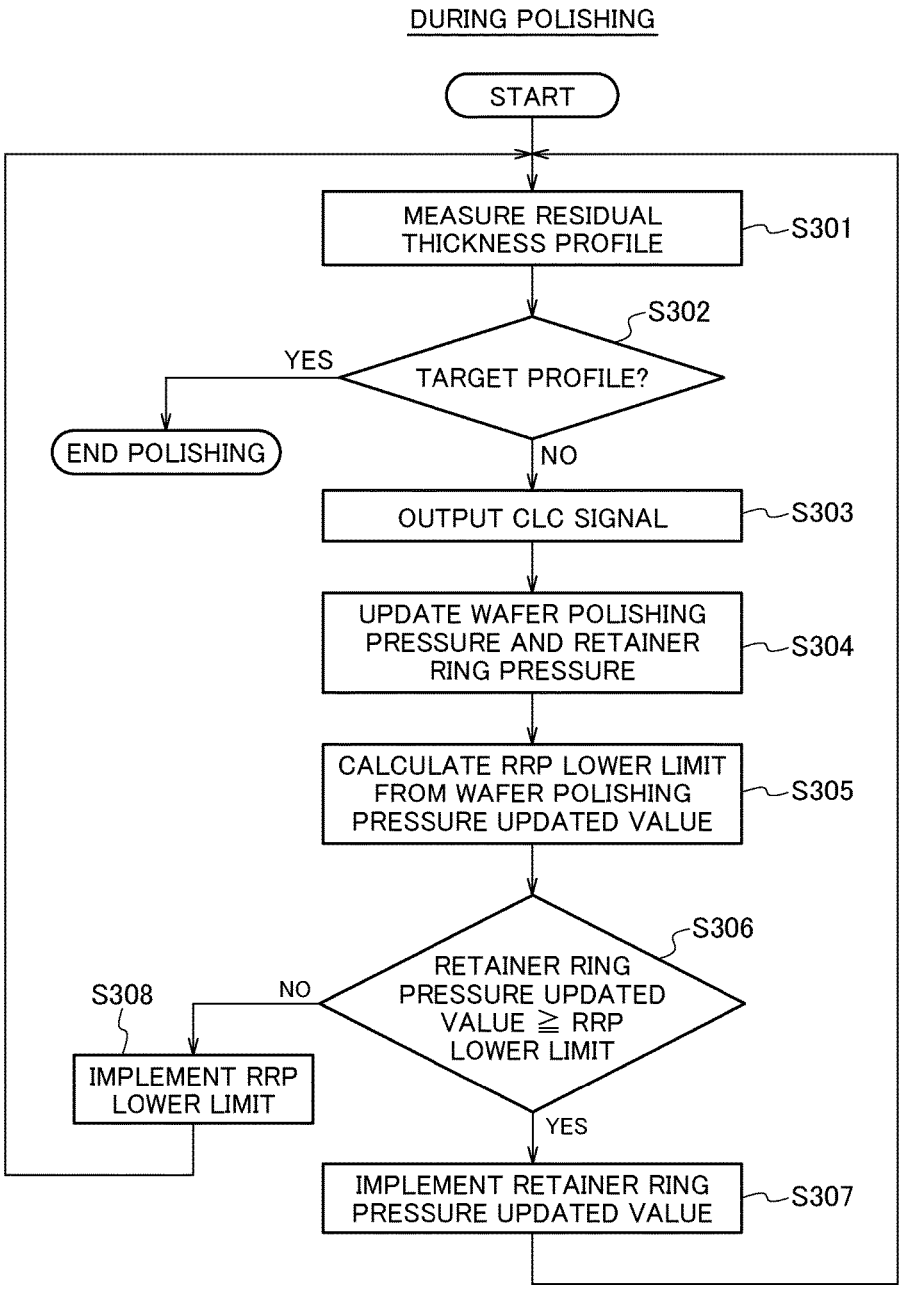
FIG. 10 is a flowchart showing an example of a process during polishing according to Example 1.

FIG. 10 is a flowchart showing an example of a process during polishing according to Example 1. First, the control unit 500 in FIG. 3 executes control to start the semiconductor wafer W. At this time, the pressing unit presses the back surface of the surface to be polished of the semiconductor wafer W such that the surface to be polished is pressed against the polishing pad 101.

(Step S301) The thickness measurement unit 40 measures the residual thickness profile and outputs the measured value to the closed-loop control device 502 in the control unit 500.

(Step S302) Next, the closed-loop control device 502 in the control unit 500 determines whether or not the residual thickness profile becomes the targeted profile. If the residual thickness profile becomes the targeted profile, the control unit 500 ends the polishing.

(Step S303) On the other hand, if it is determined that the residual thickness profile does not become the targeted profile, the closed-loop control device 502 calculates, based on the residual thickness profile, the pressure instruction values (pressure parameters) for the fluids to be supplied to the central chamber 5, the ripple chamber 6, the outer chamber 7, the edge chamber 8, and the retainer ring pressure chamber 9 (hereinafter, collectively referred to as the "pressure chamber") to output the CLC signal indicating these pressure instruction values to the polishing control device 501 in the control unit 500.

(Step S304) The polishing control device 501 updates the wafer polishing pressure and the retainer ring pressure by using the CLC signal.

(Step S305) The polishing control device 501 substitutes a wafer polishing pressure updated value updated at step S304 into the formula (6), and calculates the lower limit (RRP lower limit) $P_{RRPS}$ of the retainer ring pressure at which the semiconductor wafer W does not slip out in accordance with the formula (6).

(Step S306) Next, it is determined whether or not a retainer ring pressure updated value updated at step S304 is equal to or more than the RRP lower limit $P_{RRPS}$ calculated at step S305.

(Step S307) If it is determined at step S306 that the retainer ring pressure updated value is equal to or more than the RRP lower limit $P_{RRPS}$, the retainer ring pressure is controlled to become the retainer ring pressure updated value. After that, the process returns to step S301.

(Step S308) If it is determined at step S306 that the retainer ring pressure updated value is not equal to or more than the RRP lower limit $P_{RRPS}$ (that is, the retainer ring pressure updated value is less than the RRP lower limit $P_{RRPS}$), the RRP lower limit $P_{RRPS}$ is controlled to become the retainer ring pressure. After that, the process returns to step S301.

As described above, those illustrated in FIG. 10 is summarized as that the storage unit 530 stores therein the relationship between the pressing force of the pressing unit and the lower limit of the pressing force of the retainer member at which the polishing object does not slip out. Note that this relationship is not limited to the relational expression buy may be a table or the like. Then, the control unit 500 acquires the current pressing force of the pressing unit during polishing of the surface to be polished, applies the current pressing force of the pressing unit to the "relationship between the pressing force of the pressing unit and the lower limit of the pressing force of the retainer member at which the polishing object does not slip out" (see the formula (6)) stored in the storage unit 530, determines the lower limit (RRP lower limit) $P_{RRPS}$ of the pressing force of the retainer member at which the polishing object does not slip out, and controls the pressing force of the retainer member so that the pressing force of the retainer member is equal to or more than the RRP lower limit $P_{RRPS}$.

By doing so, the pressing force of the retainer member is set to be equal to or more than the RRP lower limit $P_{RRPS}$, which makes it possible to prevent the polishing object from slipping out.

In this Example, as an example thereof, the control unit 500 keeps the current pressing force of the retainer member if the current pressing force of the retainer member is equal to or more than the lower limit, and sets the pressing force of the retainer member to the lower limit if the current pressing force of the retainer member is less than the lower limit. By doing so, the pressing force of the retainer member is always set to be equal to or more than the RRP lower limit $P_{RRPS}$, which makes it possible to prevent the polishing object from slipping out.

Note that the control unit 500 uses the relationship between the pressing force of the pressing unit and the "lower limit" of the pressing force of the retainer member at which the polishing object "does not slip out", but, not limited thereto, may use the relationship between the pressing force of the pressing unit and the "upper limit" of the pressing force of the retainer member at which the polishing object "slips out". In this case, the storage unit 530 stores therein the relationship between the pressing force of the pressing unit and the upper limit of the pressing force of the retainer member at which the polishing object slips out. Note that this relationship is not limited to the relational expression buy may be a table or the like. Then, the control unit 500 may acquire the current pressing force of the pressing unit during polishing of the surface to be polished, apply the current pressing force of the pressing unit to the "relationship between the pressing force of the pressing unit and the upper limit of the pressing force of the retainer member at which the polishing object slips out" stored in the storage unit 530, determine the upper limit of the pressing force of the retainer member at which the polishing object slips out, and control the pressing force of the retainer member so that the pressing force of the retainer member exceeds the upper limit.

By doing so, the pressing force of the retainer member exceeds the upper limit of the pressing force of the retainer member at which the polishing object slips out, which makes it possible to prevent the polishing object from slipping out.

EXAMPLE 2

Subsequently, a description is given of Example 2. A description is given of a method for deciding an upper limit of the total table rotary torque $T_t$ at which no slipping-out occurs with reference to FIGS. 11A to 11C. Here, the total table rotary torque $T_t$ is a sum of the table rotary torque $T_r$ in the case of polishing only the retainer ring and the table rotary torque $T_w$ in the case of polishing only the wafer ($T_t=T_r+T_w$).

Figure 11A:
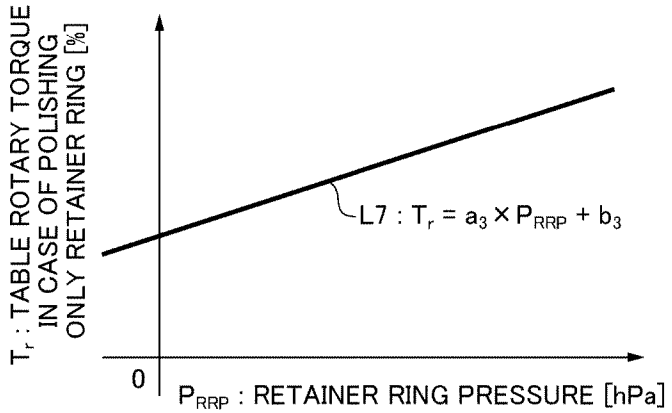
FIG. 11A is an exemplary graph showing a relationship between the retainer ring pressure $P_{RRP}$ and the table rotary torque $T_r$ in the case of polishing only the retainer ring.

FIG. 11A is an exemplary graph showing a relationship between the retainer ring pressure $P_{RRP}$ and the table rotary torque $T_r$ in the case of polishing only the retainer ring. As shown by a straight line L7 in FIG. 11A, the retainer ring pressure $P_{RRP}$ and the table rotary torque $T_r$ in the case of polishing only the retainer ring have a linear relationship. The table rotary torque $T_r$ in the case of polishing only the retainer ring is represented by the next formula (7).

$$T_r=a_3\times P_{RRP}+b_3 \quad (7)$$

Here, $a_3$ is a coefficient representing a slope, and $b_3$ is a coefficient representing an intercept. Since these coefficients $a_3$ and $b_3$ vary if the coefficient of friction of the polishing surface 101*a* changes, the coefficients need to be anew acquired in the case the coefficient of friction of the polishing surface 101*a* may possibly change. The case where the coefficient of friction of the polishing surface 101*a* may possibly change is, for example, a case where the table rotation frequency, the polishing pad 101, the polishing pad front surface state, the slurry type, the slurry flow rate, the wafer film type, the retainer ring groove, the retainer ring width or the like is changed.

Figure 11B:
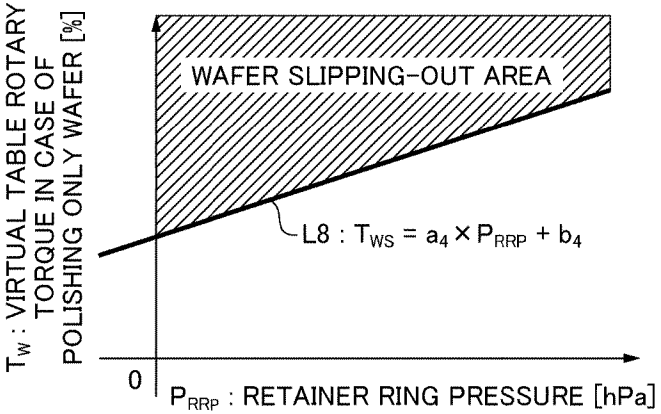
FIG. 11B is an exemplary graph showing a relationship between the retainer ring pressure $P_{RRP}$ and the upper limit $T_{wS}$ of the table rotary torque at which the semiconductor wafer W does not slip out in the case of polishing only the wafer.

FIG. 11B is an exemplary graph showing a relationship between the retainer ring pressure $P_{RRP}$ and the upper limit $T_{wS}$ of the table rotary torque at which the semiconductor wafer W does not slip out in the case of polishing only the wafer. An ordinate represents the table rotary torque $T_w$ in the case of polishing only the wafer, and an abscissa represents the retainer ring pressure $P_{RRP}$. As shown by a straight line L8 in FIG. 11B, the retainer ring pressure $P_{RRP}$ and the upper limit $T_{wS}$ of the table rotary torque at which the semiconductor wafer W does not slip out in the case of polishing only the wafer have a linear relationship. An area above the straight line L8 in FIG. 11B is the wafer slipping-out area. The upper limit $T_{wS}$ of the table rotary torque at which the semiconductor wafer W does not slip out in the case of polishing only the wafer is represented by the next formula (8).

$$T_{wS}=a_4\times P_{RRP}+b_4 \quad (8)$$

Here, $a_4$ is a coefficient representing a slope, and $b_4$ is a coefficient representing an intercept. These coefficients $a_4$ and $b_4$ do not vary even if the coefficient of friction of the polishing surface 101*a* changes. As represented by the next formula (9), the table rotary torque $T_w$ in the case of polishing only the wafer needs to be equal to or less than the upper limit $T_{wS}$ of the table rotary torque at which the semiconductor wafer W does not slip out in the case of polishing only the wafer.

$$T_w<T_{wS} \quad (9)$$

Here, there is no dress as an example in the embodiment, and thus, a relationship of $T_t=T_w+T_r$ is established. If the formula (8) is substituted into $T_{wS}$ on the right side of the formula (9), and $T_w=T_t-T_r$ is substituted into $T_w$ on the left side of the formula (9), the next formula (10) is obtained.

$$T_t-T_r\leq a_4\times P_{RRP}+b_4 \quad (10)$$

Further, if the formula (7) is substituted into $T_r$ on the left side of the formula (10), the next formula (11) is obtained.

$$T_t-(a_3\times P_{RRP}+b_3)\leq a_4\times P_{RRP}+b_4 T_t\leq(a_3+a_4)P_{RRP}+b_3+b_4=T_{ts} \quad (11)$$

Figure 11C:
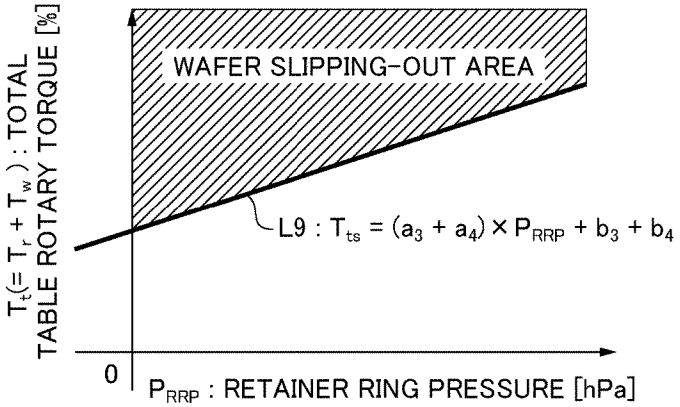
FIG. 11C is an exemplary graph showing a relationship between the retainer ring pressure $P_{RRP}$ and the upper limit $T_{tS}$ of the table rotary torque at which the semiconductor wafer W does not slip out.

Here, $T_{ts}$ is the upper limit $T_{ts}$ of the table rotary torque at which the semiconductor wafer W does not slip out. FIG. 11C is an exemplary graph showing a relationship between the retainer ring pressure $P_{RRP}$ and the upper limit $T_{ts}$ of the table rotary torque at which the semiconductor wafer W does not slip out. An ordinate represents the upper limit $T_{ts}$ of the table rotary torque, and an abscissa represents the retainer ring pressure $P_{RRP}$. An area above a straight line L9 in FIG. 11C is the wafer slipping-out area.

Figure 12:
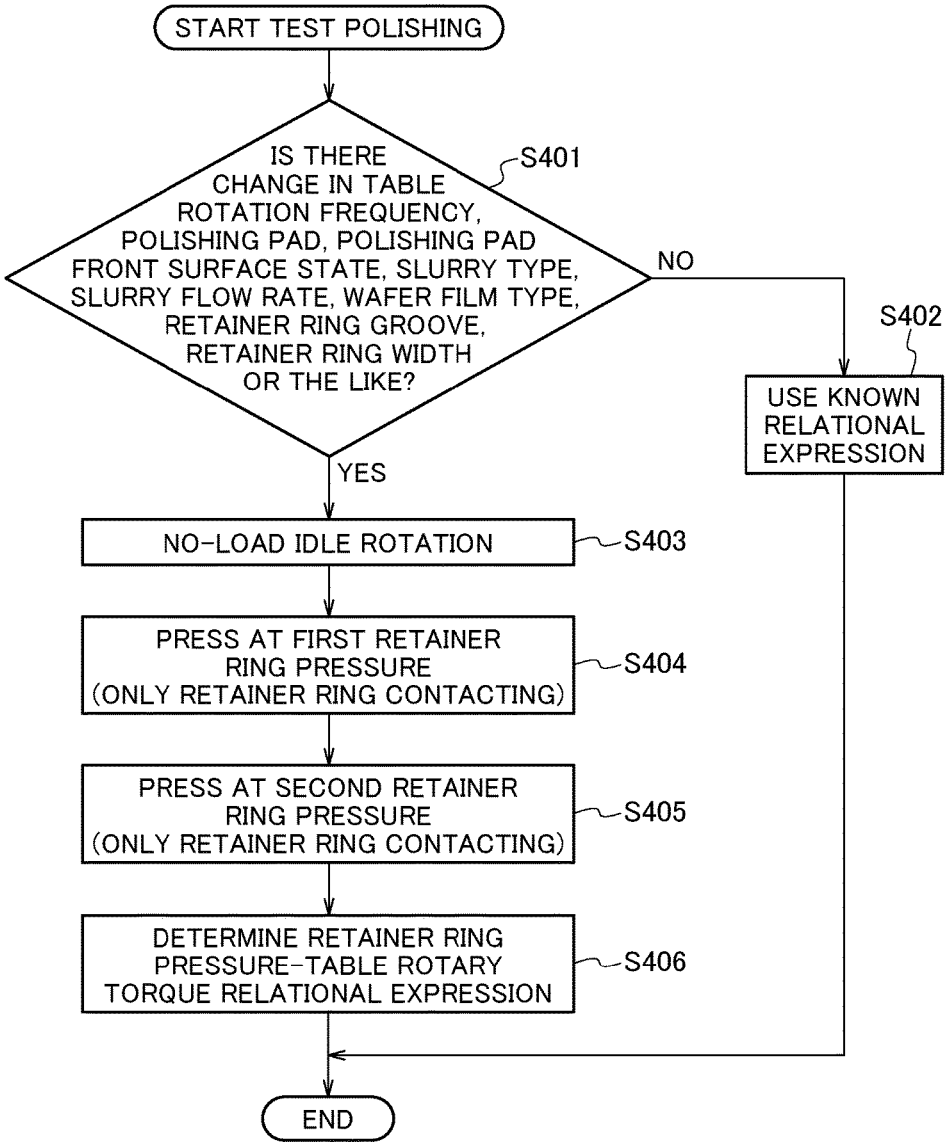
FIG. 12 is a flowchart showing an example of a process in test polishing for according to Example 2.

Subsequently, a description is given of a method for deciding the coefficient $a_3$ and coefficient $b_3$ of the formula (7) with reference to FIG. 12. FIG. 12 is a flowchart showing an example of a process in test polishing for according to Example 2. In this test polishing, acquired is the relationship between the retainer ring pressure $P_{RRP}$ and the table rotary torque $T^r$ in the case of polishing only the retainer ring.

(Step S401) The control unit 500 determines whether or not there is a change in the table rotation frequency, the polishing pad 101, a polishing pad front surface state, the slurry type, the slurry flow rate, the wafer film type, the retainer ring groove, the retainer ring width or the like. If there is some change here, this is the case where the coefficient of friction may possibly change.

(Step S402) If it is determined at step S401 that there is no change in the table rotation frequency, the polishing pad 101, the polishing pad front surface state, the slurry type, the slurry flow rate, the wafer film type, the retainer ring groove, the retainer ring width or the like, the control unit 500 uses the known relational expression for the retainer ring pressure $P_{RRP}$ and the table rotary torque $T_r$ in the case of polishing only the retainer ring.

(Step S403) If it is determined at step S401 that there is a change in the table rotation frequency, the polishing pad 101, the polishing pad front surface state, the slurry type, the slurry flow rate, the wafer film type, the retainer ring groove, the retainer ring width or the like, the control unit 500 controls the polishing table 100 to be rotated at a predetermined speed in no-load idle rotation. Then, the control unit 500 acquires the table rotary torque $T_r$ at this time as the coefficient $b_3$.

(Step S404) Next, the control unit 500 presses the retainer ring 3 at a first retainer ring pressure p3 while it rotates the polishing table 100 at a predetermined speed, with a state where the semiconductor wafer W is not in contact with the polishing pad 101 and the retainer ring 3 is brought into contact with polishing pad 101. Then, the control unit 500 acquires the table rotary torque T3 at this time.

(Step S405) Next, the control unit 500 presses the retainer ring 3 at a second retainer ring pressure p4 while it rotates the polishing table 100 at a predetermined speed, with a state where the semiconductor wafer W is not in contact with the polishing pad 101 and the retainer ring 3 is brought into contact with polishing pad 101. Then, the control unit 500 acquires the table rotary torque T4 at this time.

(Step S406) Then, the control unit 500 calculates the coefficient $a_3$(=(T4−T3)/(p4−p3)). By doing so, the relational expression is determined for the retainer ring pressure $P_{RRP}$ and the upper limit $T_{ts}$ of the table rotary torque at which the semiconductor wafer W does not slip out (that is, the formula (7)). Then, the control unit 500 updates and stores the coefficient $a_3$ and the coefficient $b_3$. By doing so, the coefficient $a_3$ the coefficient $b_3$ are updated, which also updates the formula (11).

Figure 13:
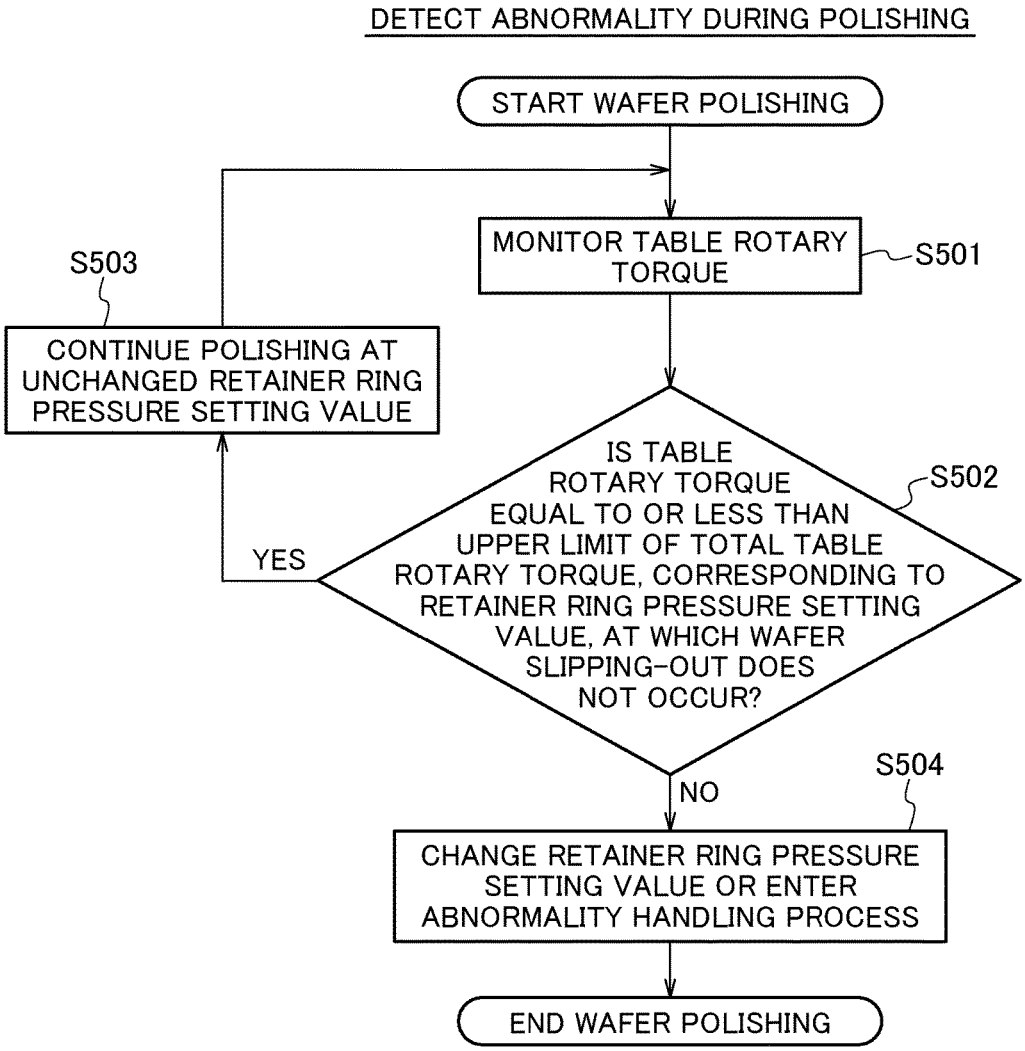
FIG. 13 is a flowchart showing an example of the abnormality detecting process during polishing according to Example 2.

Subsequently, a description is given of an abnormality detecting process during polishing according to Example 2. FIG. 13 is a flowchart showing an example of the abnormality detecting process during polishing according to Example 2. First, the control unit 500 executes control to start the semiconductor wafer W. At this time, the pressing unit presses the back surface of the surface to be polished of the semiconductor wafer W such that the surface to be polished is pressed against the polishing pad 101.

(Step S501) The control unit 500 monitors, during polishing, the rotary torque (table rotary torque) of the table rotary motor 103 during polishing of the surface to be polished. Specifically, for example, the control unit 500 updates the table rotary torque from the value of the current applied to the table rotary motor 103 during polishing of the surface to be polished.

(Step S502) Next, the control unit 500 determines whether or not the table rotary torque detected at step S501 is equal to or less than the upper limit $T_{ts}$ of the table rotary torque at which the semiconductor wafer W does not slip out (i.e., wafer slipping-out does not occur), the upper limit being obtained by substituting the retainer ring pressure setting value into the formula (11). In other words, the control unit 500 determines whether or not the table rotary torque detected at step S501 is equal to or less than the upper limit $T_{ts}$ of the table rotary torque, corresponding to the retainer ring pressure setting value, at which the wafer slipping-out does not occur.

(Step S503) If it is determined at step S502 that the table rotary torque is equal to or less than the upper limit $T_{ts}$ of the table rotary torque at which the wafer slipping-out does not occur, the control unit 500 continues the polishing at the unchanged retainer ring pressure setting value.

(Step S504) If it is determined at step S502 that the table rotary torque is not equal to or less than the upper limit $T_{ts}$ of the table rotary torque at which the wafer slipping-out does not occur (that is, the table rotary torque exceeds the upper limit $T_{ts}$ of the table rotary torque at which the wafer slipping-out does not occur), the control unit 500 increases the retainer ring pressure setting value or performs a predetermined abnormal handling process. When increasing the retainer ring pressure setting value, the control unit 500 may change, for example, the retainer ring pressure setting value into predetermined times the current retainer ring pressure setting value (e.g., 1.3 times). The abnormal handling process includes, for example, a process of forcibly terminating the polishing with the polishing pressure not being applied, a process of polishing using water, or a process of decreasing only a pressure against the membrane with the retainer ring pressure not being decreased. After that, the control unit 500 ends the polishing of the semiconductor wafer W.

As described above, those illustrated in FIG. 13 is summarized as that the storage unit 530 stores therein the relationship between the pressing force of the retainer member and the upper limit of the rotary torque at which the polishing object does not slip out. Note that this relationship is not limited to the relational expression buy may be a table or the like. Then, the control unit 500 acquires the setting value for the pressing force of the retainer member, applies the acquired setting value for the pressing force of the retainer member to the "relationship between the pressing force of the retainer member and the upper limit of the rotary torque at which the polishing object does not slip out" stored in the storage unit 530, determines the upper limit of the rotary torque at which the polishing object does not slip out, compares the upper limit with the rotary torque of the table rotary motor 103 during polishing of the surface to be polished, and performs a process depending on a comparison result.

By doing so, the control unit 500 can control such that the rotary torque of the table rotary motor during polishing does not exceed the upper limit, which makes it possible to prevent the polishing object from slipping out.

In this Example, the process depending on the comparison result is a process to control the polishing to be continued at the setting value for the pressing force of the retainer member if the rotary torque of the table rotary motor 103 during polishing is equal to or less than the upper limit, and to increase the pressing force of the retainer member or perform a predetermined abnormal handling process if the rotary torque of the table rotary motor 103 during polishing exceeds the upper limit.

By doing so, the polishing can be continued in a range where the rotary torque does not exceed the upper limit, and if the rotary torque exceeds the upper limit, the pressing force of the retainer member is increased or a predetermined abnormal handling process is performed so that the polishing object can be prevented from slipping out.

The relationship between the pressing force of the retainer member and the upper limit of the rotary torque at which the polishing object does not slip out (see the relationship in FIG. 11C) is determined based on the relationship between the pressing force of the retainer member and the upper limit of the rotary torque at which the polishing object does not slip out (see the relationship in FIG. 11B) in the virtual case where the retainer member is not pressed against the polishing member and the polishing object is pressed against the polishing member as well as the relationship between the pressing force of the retainer member and the rotary torque (see the relationship in FIG. 11A) in the case where the retainer member is pressed against the polishing member and the polishing object is not pressed against the polishing member.

This can determine a relationship between the pressing force of the retainer member and the upper limit of the rotary torque at which the polishing object does not slip out.

The control unit 500 acquires, when the coefficient of friction between the surface to be polished and the polishing member may possibly change (in the case of YES at step S401 in FIG. 12), the relationship between the pressing force of the retainer member and the rotary torque (see the relationship in FIG. 11A) in the case where the retainer member is pressed against the polishing member and the polishing object is not pressed against the polishing member (see steps S403 to S406 in FIG. 12). Then, the control unit 500 updates the relationship between the pressing force of the retainer member and the upper limit of the rotary torque at which the polishing object does not slip out (see the relationship in FIG. 11C) by using the acquired relationship.

By doing so, every time the coefficient of friction between the surface to be polished and the polishing member may possibly change, updated is the relationship between the pressing force of the retainer member and the upper limit of the rotary torque at which the polishing object does not slip out.

Note that the control unit 500 uses the relationship between the pressing force of the retainer member and the "upper limit" of the rotary torque at which the polishing object "does not slip out", but, not limited thereto, may use a relationship between the pressing force of the retainer member and a "lower limit" of the rotary torque at which the polishing object "slips out". In this case, the storage unit 530 stores therein the relationship between the pressing force of the retainer member and the lower limit of the rotary torque at which the polishing object slips out. Note that this relationship is not limited to the relational expression buy may be a table or the like. Then, the control unit 500 may acquire the setting value for the pressing force of the retainer member, apply the acquired setting value for the pressing force of the retainer member to the "relationship between the pressing force of the retainer member and the lower limit of the rotary torque at which the polishing object slips out" stored in the storage unit 530, and determine the lower limit of the rotary torque at which the polishing object slips out. Then, the control unit 500 may compare the lower limit with the rotary torque of the table rotary motor during polishing of the surface to be polished to perform a process depending on a comparison result.

By doing so, the control unit 500 can control such that the rotary torque of the table rotary motor during polishing falls below the lower limit, which makes it possible to prevent the polishing object from slipping out.

Note that a program for executing the processes of the control unit 500 in the embodiment may be recorded in a computer-readable recording medium such that the program recorded in the recording medium is read by a computer system and executed by a processor to perform the above-described processes of the control unit 500 according to the embodiment.

As described above, this technique is not limited to the above embodiment and may be embodied by modifying the components without departing from a scope of the gist of the embodiment when implementing this technique. A plurality of components disclosed in the embodiment may be adequately combined to form various inventions. For example, some components may be omitted from all of the components shown by the embodiment. Further, the components across different embodiments may be adequately combined.

What is claimed is:

1. A polishing apparatus for polishing a surface to be polished of an polishing object by sliding the surface to be polished and a polishing member relative to each other, comprising:

a pressing unit that presses a back surface of the surface to be polished of the polishing object such that the surface to be polished is pressed against the polishing member;

a retainer member that is arranged on an outer side of the pressing unit and presses the polishing member;

a storage unit that stores information concerning a condition for preventing the polishing object from slipping out, the condition being defined by use of information concerning a pressing force of the retainer member; and a control unit that acquires information concerning a force of friction between the surface to be polished of the polishing object and the polishing member or information concerning the pressing force of the retainer member, and executes control for adapting to the condition for preventing the slipping-out by using the acquired information concerning the force of friction or the acquired information concerning the pressing force of the retainer member.

2. The polishing apparatus according to claim 1, wherein the control unit controls the pressing force of the retainer member so as to adapt to the condition for preventing the slipping-out depending on the information concerning the force of friction between the surface to be polished of the polishing object and the polishing member during polishing.

3. The polishing apparatus according to claim 1, wherein the information concerning the force of friction between the surface to be polished of the polishing object and the polishing member is a pressing force of the pressing unit during polishing, the information concerning the condition for preventing the polishing object from slipping out is a relationship between the pressing force of the pressing unit and a lower limit of the pressing force of the retainer member at which the polishing object does not slip out, and the control unit acquires a current pressing force of the pressing unit during polishing of the surface to be polished, applies the current pressing force of the pressing unit to the relationship between the pressing force of the pressing unit and the lower limit of the pressing force of the retainer member at which the polishing object does not slip out, determines the lower limit of the pressing force of the retainer member at which the polishing object does not slip out, and controls the pressing force of the retainer member so that the pressing force of the retainer member is equal to or more than the lower limit.

4. The polishing apparatus according to claim 3, wherein the control unit keeps the current pressing force of the retainer member if the current pressing force of the retainer member is equal to or more than the lower limit, and sets the pressing force of the retainer member to the lower limit if the current pressing force of the retainer member is less than the lower limit.

5. The polishing apparatus according to claim 1, wherein the information concerning the force of friction between the surface to be polished of the polishing object and the polishing member is a setting value for a pressing force of the pressing unit, the information concerning the condition for preventing the polishing object from slipping out is a relationship between the pressing force of the pressing unit and a lower limit of the pressing force of the retainer member at which the polishing object does not slip out, and the control unit acquires the setting value for the pressing force of the pressing unit and a setting value for the pressing force of the retainer member, applies the setting value for the pressing force of the pressing unit to the relationship between the pressing force of the pressing unit and the lower limit of the pressing force of the retainer member at which the polishing object does not slip out, determines the lower limit of the pressing force of the retainer member at which the polishing object does not slip out, and executes control for informing in a case where the setting value for the pressing force of the retainer member falls below the lower limit.

6. The polishing apparatus according claim 3, wherein the relationship between the pressing force of the pressing unit and the lower limit of the pressing force of the retainer member at which the polishing object does not slip out is determined based on a relationship between the information concerning the force of friction between the surface to be polished of the polishing object and the polishing member and the lower limit of the pressing force of the retainer member at which the polishing object does not slip out in a virtual case where the retainer member is not pressed against the polishing member and the polishing object is pressed against the polishing member as well as a relationship between the information concerning the force of friction between the surface to be polished of the polishing object and the polishing member and the pressing force of the pressing unit.

7. The polishing apparatus according to claim 6, wherein the control unit acquires, when a coefficient of friction between the surface to be polished and the polishing member may possibly change, the relationship between the information concerning the force of friction between the surface to be polished of the polishing object and the polishing member and the pressing force of the pressing unit in the virtual case where the retainer member is not pressed against the polishing member and the polishing object is pressed against the polishing member, and updates the relationship between the pressing force of the pressing unit and the lower limit of the pressing force of the retainer member at which the polishing object does not slip out by using the acquired relationship.

8. The polishing apparatus according to claim 7, further comprising:

a polishing table that holds the polishing member on a front surface thereof;

a table rotary motor that rotates the polishing table; and a pressing unit rotary motor that rotates the pressing unit, wherein the information concerning the force of friction in terms of the relationship between the information concerning the force of friction between the surface to be polished of the polishing object and the polishing member and the pressing force of the pressing unit is the force of friction between the surface to be polished and the polishing member, a rotary torque of the polishing table or a current value of the table rotary motor, or a rotary torque of the pressing unit or a current value of the pressing unit rotary motor.

9. The polishing apparatus according to claim 1, further comprising:

a polishing table that holds the polishing member on a front surface thereof; and a table rotary motor that rotates the polishing table, wherein the information concerning the pressing force of the retainer member is a setting value for the pressing force of the retainer member, the information concerning the condition for preventing the polishing object from slipping out is a relationship between the pressing force of the retainer member and an upper limit of a rotary torque at which the polishing object does not slip out, and the control unit acquires the setting value for the pressing force of the retainer member, applies the acquired setting value for the pressing force of the retainer member to the relationship between the pressing force of the retainer member and the upper limit of the rotary torque at which the polishing object does not slip out, determines the upper limit of the rotary torque at which the polishing object does not slip out, compares the upper limit with a rotary torque of the table rotary motor during polishing of the surface to be polished, and performs a process depending on a comparison result.

10. The polishing apparatus according to claim 9, wherein the process depending on the comparison result is a process to control the polishing to be continued at the setting value for the pressing force of the retainer member if the rotary torque of the table rotary motor during polishing is equal to or less than the upper limit, and to increase the pressing force of the retainer member or perform a predetermined abnormal handling process if the rotary torque of the table rotary motor during polishing exceeds the upper limit.

11. The polishing apparatus according to claim 9, wherein a relationship between the pressing force of the retainer member and the upper limit of the rotary torque at which the polishing object does not slip out is determined based on the relationship between the pressing force of the retainer member and the upper limit of the rotary torque at which the polishing object does not slip out in a virtual case where the retainer member is not pressed against the polishing member and the polishing object is pressed against the polishing member as well as the relationship between the pressing force of the retainer member and the rotary torque in a case where the retainer member is pressed against the polishing member and the polishing object is not pressed against the polishing member.

12. The polishing apparatus according to claim 11, wherein the control unit acquires, when a coefficient of friction between the surface to be polished and the polishing member may possibly change, the relationship between the pressing force of the retainer member and the rotary torque in the case where the retainer member is pressed against the polishing member and the polishing object is not pressed against the polishing member, and updates the relationship between the pressing force of the retainer member and the upper limit of the rotary torque at which the polishing object does not slip out by using the acquired relationship.

13. The polishing apparatus according to claim 1, wherein the information concerning the force of friction between the surface to be polished of the polishing object and the polishing member is a pressing force of the pressing unit during polishing, the information concerning the condition for preventing the polishing object from slipping out is a relationship between the pressing force of the pressing unit and an upper limit of the pressing force of the retainer member at which the polishing object slips out, and the control unit acquires a current pressing force of the pressing unit during polishing of the surface to be polished, applies the current pressing force of the pressing unit to the relationship between the pressing force of the pressing unit and the upper limit of the pressing force of the retainer member at which the polishing object slips out, determines the upper limit of the pressing force of the retainer member at which the polishing object slips out, and controls the pressing force of the retainer member so that the pressing force of the retainer member exceeds the upper limit.

14. The polishing apparatus according to claim 1, wherein the information concerning the force of friction between the surface to be polished of the polishing object and the polishing member is a setting value for a pressing force of the pressing unit, the information concerning the condition for preventing the polishing object from slipping out is a relationship between the pressing force of the pressing unit and an upper limit of the pressing force of the retainer member at which the polishing object slips out, and the control unit acquires the setting value for the pressing force of the pressing unit and a setting value for the pressing force of the retainer member, applies the setting value for the pressing force of the pressing unit to the relationship between the pressing force of the pressing unit and the upper limit of the pressing force of the retainer member at which the polishing object slips out, determines the upper limit of the pressing force of the retainer member at which the polishing object slips out, and executes control for informing in a case where the setting value for the pressing force of the retainer member is equal to or less than the upper limit.

15. The polishing apparatus according to claim 1, further comprising:

a polishing table that holds the polishing member on a front surface thereof;

a table rotary motor that rotates the polishing table; and wherein the information concerning the pressing force of the retainer member is a setting value for the pressing force of the retainer member, the information concerning the condition for preventing the polishing object from slipping out is a relationship between the pressing force of the retainer member and a lower limit of a rotary torque at which the polishing object slips out, and the control unit acquires the setting value for the pressing force of the retainer member, applies the acquired setting value for the pressing force of the retainer member to the relationship between the pressing force of the retainer member and the lower limit of the rotary torque at which the polishing object slips out, determines the lower limit of the rotary torque at which the polishing object slips out, compares the lower limit with a rotary torque of the table rotary motor during polishing of the surface to be polished, and performs a process depending on a comparison result.

16. The polishing apparatus according to claim 1, wherein the condition for preventing the slipping-out is a condition that the pressing force of the retainer member is equal to or more than, or exceeds a threshold pressing force corresponding to the rotary torque of the table rotary motor in a virtual case where the retainer member is not pressed against the polishing member and the polishing object is pressed against the polishing member.

17. The polishing apparatus according to claim 16, wherein the condition for preventing the slipping-out is a condition that the pressing force of the retainer member is equal to or more than a value of a linear function of the rotary torque of the table rotary motor in the virtual case where the retainer member is not pressed against the polishing member and the polishing object is pressed against the polishing member.

18. A control method for executing control by way of referencing a storage unit that stores information concerning a condition for preventing an polishing object from slipping out, the condition being defined by use of information concerning a pressing force of a retainer member, the method comprising:

a step of acquiring information concerning a force of friction between a surface to be polished of the polishing object and a polishing member, or the information concerning the pressing force of the retainer member; and a step of executing control for adapting to the condition for preventing the slipping-out by using the acquired information concerning the force of friction or the acquired information concerning the pressing force of the retainer member.

19. A recording medium storing therein in a non-transitory manner a program for executing control by way of referencing a storage unit that stores information concerning a condition for preventing an polishing object from slipping out, the condition being defined by use of information concerning a pressing force of a retainer member, the program causing a computer to execute:

a step of acquiring information concerning a force of friction between a surface to be polished of the polishing object and a polishing member, or the information concerning the pressing force of the retainer member; and a step of executing control for adapting to the condition for preventing the slipping-out by using the acquired information concerning the force of friction or the acquired information concerning the pressing force of the retainer member.

* * * * *